US007625186B1

(12) United States Patent
Lueddecke

(10) Patent No.: US 7,625,186 B1
(45) Date of Patent: Dec. 1, 2009

(54) LARGE AREA FAN AND FAN BLADES USABLE FOR LARGE SPACES

(76) Inventor: Leon L. Lueddecke, N. 12445 Division Ave., Unity, WI (US) 54488

( * ) Notice: Subject to any disclaimer, the term of this patent is extended or adjusted under 35 U.S.C. 154(b) by 541 days.

(21) Appl. No.: 11/120,782

(22) Filed: May 3, 2005

Related U.S. Application Data

(60) Provisional application No. 60/569,349, filed on May 7, 2004.

(51) Int. Cl.
*F04D 29/38* (2006.01)

(52) U.S. Cl. ..... 416/243; 416/244 R

(58) Field of Classification Search ..... 416/243, 416/210 R, 238, 235, 237
See application file for complete search history.

(56) References Cited

U.S. PATENT DOCUMENTS 578,360 A * 3/1897 Phillips et al. ..... 416/238
871,729 A 11/1907 McChord, Jr.
1,055,947 A 3/1913 Schwartzberg
1,150,241 A * 8/1915 Banzhof ..... 416/210 R
1,473,066 A * 11/1923 Wells ..... 416/235
1,501,201 A * 7/1924 Cates ..... 416/238
1,820,448 A * 8/1931 Davy ..... 416/237
2,243,189 A * 5/1941 Brannan ..... 416/243
3,625,635 A * 12/1971 Stonack ..... 416/210 R
3,733,147 A * 5/1973 Felker ..... 416/214 R
4,364,712 A * 12/1982 Charles ..... 416/237
4,618,313 A 10/1986 Mosiewicz
4,662,823 A 5/1987 Cooke
4,892,460 A 1/1990 Volk
5,007,811 A * 4/1991 Hopkins ..... 135/16
6,244,821 B1 * 6/2001 Boyd et al. ..... 416/210 R
6,589,016 B2 7/2003 Boyd et al.
6,884,034 B1 * 4/2005 Parker et al. ..... 416/223 R
6,991,431 B2 * 1/2006 Ching Wen ..... 416/243
2002/0001521 A1 * 1/2002 Boyd et al. ..... 416/1
2004/0009071 A1 * 1/2004 Bird ..... 416/238
2004/0084544 A1 5/2004 Boyd et al.

* cited by examiner

*Primary Examiner*—Richard Edgar
(74) *Attorney, Agent, or Firm*—Lathrop & Clark LLP

(57) ABSTRACT

Conventional large area fans generally create a cylinder of air having a diameter that is essentially equal to the diameter of the fan. Larger diameter fans require heavier-duty motors and gearboxes to drive the longer fan blades and are heavier, and thus are more difficult to mount, require heavier-duty mounting fixtures, and are more likely to fall. One large area fan according to this invention forms a cone of air. Some fan blades according to this invention have a relatively straight leading edge portion attached to the fan and a generally curved trailing portion extending downwardly from the relatively straight leading edge portion that interacts with the air to create a conical or cone-shaped flow of air from the fan. Other fan blades have a curved segment and are attached to the fan at theirs leading edges. In some such fan blades, one end is offset from the other end.

44 Claims, 15 Drawing Sheets

LARGE AREA FAN AND FAN BLADES USABLE FOR LARGE SPACES

This application claims benefit under 35 U.S.C. §119 of U.S. Provisional Patent Application 60/569,349, filed May 7, 2004, which is incorporated herein by reference in its entirety.

BACKGROUND OF THE INVENTION

1. Field of the Invention

This invention relates to a fan usable to create a flow of air in a large space, such as a barn.

2. Related Art

Fans for large spaces, such as warehouses, barns used to house dairy cows and the like, generally have very long blades. One such conventional fan has a 24-foot diameter (approximately 7.3 meters). That is, the fan has blades that extend 12 feet (approximately 3.7 meters) from the axis of rotation of the fan. However, the moving air created by such known fans for large spaces generally is in the form of a cylinder having a diameter that is essentially equal to the diameter of the fan. Thus, to create a larger area in which the air moves, it is necessary to provide larger blades to such conventional fans, thus creating a fan having a larger diameter. This in turn creates a larger cylinder of moving air.

SUMMARY OF DISCLOSED EMBODIMENTS

However, merely increasing the size of the fan blades is problematic. In particular, larger diameter fans require heavier-duty motors and gearboxes to drive the longer fan blades. Larger diameter fans are also heavier, and thus are more difficult to mount, require heavier-duty mounting fixtures, and are more likely to fall. For example, the gearboxes in conventional large diameter fans are prone to failure, such as by the gearbox shafts breaking. Additionally, while conventional large diameter fans for large spaces have safety catch devices, the size of such large diameter fans can overwhelm the safety catch device, causing them to fail.

This invention provides a fan for a large space that has an intermediate length blade.

This invention separately provides a fan for a large space that is able to create moving air in an area that is larger in diameter than the diameter of the fan blades.

This invention separately provides a fan for a large space that creates a generally cone-shaped region of moving air.

This invention separately provides a fan for a large space that has fan blades that are attached to a base structure at locations adjacent to leading edges of the fan blades.

This invention separately provides a fan having relatively shorter blades that can create moving air over an area that is at least as large as an area over which a relatively larger conventional large area fan creates the moving air.

This invention separately provides a fan, having a relatively smaller motor and gearbox compared to a conventional fan for large spaces, that has a similar coverage area.

This invention separately provides a fan, having a relatively similarly-sized motor and gearbox compared to a conventional fan for large spaces, that has a larger coverage area.

This invention separately provides a fan having a safety catch that is sufficient to support the weight of the fan blades and mounting structure.

In various exemplary embodiments of a large area fan according to this invention, the fan includes a plurality of relatively shorter blades connected to a rotating plate. The rotating plate is connected to a shaft of a gearbox. The gearbox is connected both to a motor and to a suspension structure.

In various exemplary embodiments, the fan blades have a relatively straight leading edge portion and a generally curved trailing portion. The blades are attached to the rotation plate by their relatively straight leading edges. In various exemplary embodiments, the relatively straight leading edges lay flat against the rotating plate. The relatively curved trailing portions of the blades extend downwardly from the relatively straight leading edge portion and the rotating plate, and interact with the air to create a conical or cone-shaped flow of air from the fan.

In various other exemplary embodiments, at least a portion of the fan blades are in the shape of a segment of a curve, such as a circle, and are attached to the rotating plate at their leading edges. In various exemplary embodiments, such fan blades are twisted such that one end is offset from the other end of the blades. The blades are attached to the rotation plate with the concave side facing down.

In various exemplary embodiments, the suspension structures include a pole, a channel iron or other device usable to support the fan, fan blades, gear box and motor, a swivel device that allows the fan and fan blades to rotate relative to the pole, channel iron or other device, in case of a failure, a safety catch device, and/or one or more adaptor plates usable to connect the gear box and/or safety catch device to the pole, channel iron or other support device. The support structure is connected to and extends from a wall or ceiling that at least partially encloses the large space for which the fan is employed.

In various exemplary embodiments, as the fan blades according to this invention rotate with the rotating plate, they deflect or displace air. In various exemplary embodiments, some of the displaced air moves downwardly from the fan blades, while some of the displaced air moves radially along the fan blade, in addition to or in place of the downward flow. In various exemplary embodiments, the overall air flow has both radial and axial components, such that the air flow forms a cone-like shape as it leaves some exemplary fans according to this invention.

These and other features and advantages of various exemplary embodiments of the compositions, structures and methods according to this invention are described in, or are apparent from, the following detailed descriptions of various exemplary embodiments of the compositions, structures and methods according to this invention.

BRIEF DESCRIPTION OF DRAWINGS

Various exemplary embodiments of the compositions, structures and methods according to this invention will be described in detail, with reference to the following figures, wherein.

DETAILED DESCRIPTION OF EXEMPLARY EMBODIMENTS

Figure 1:
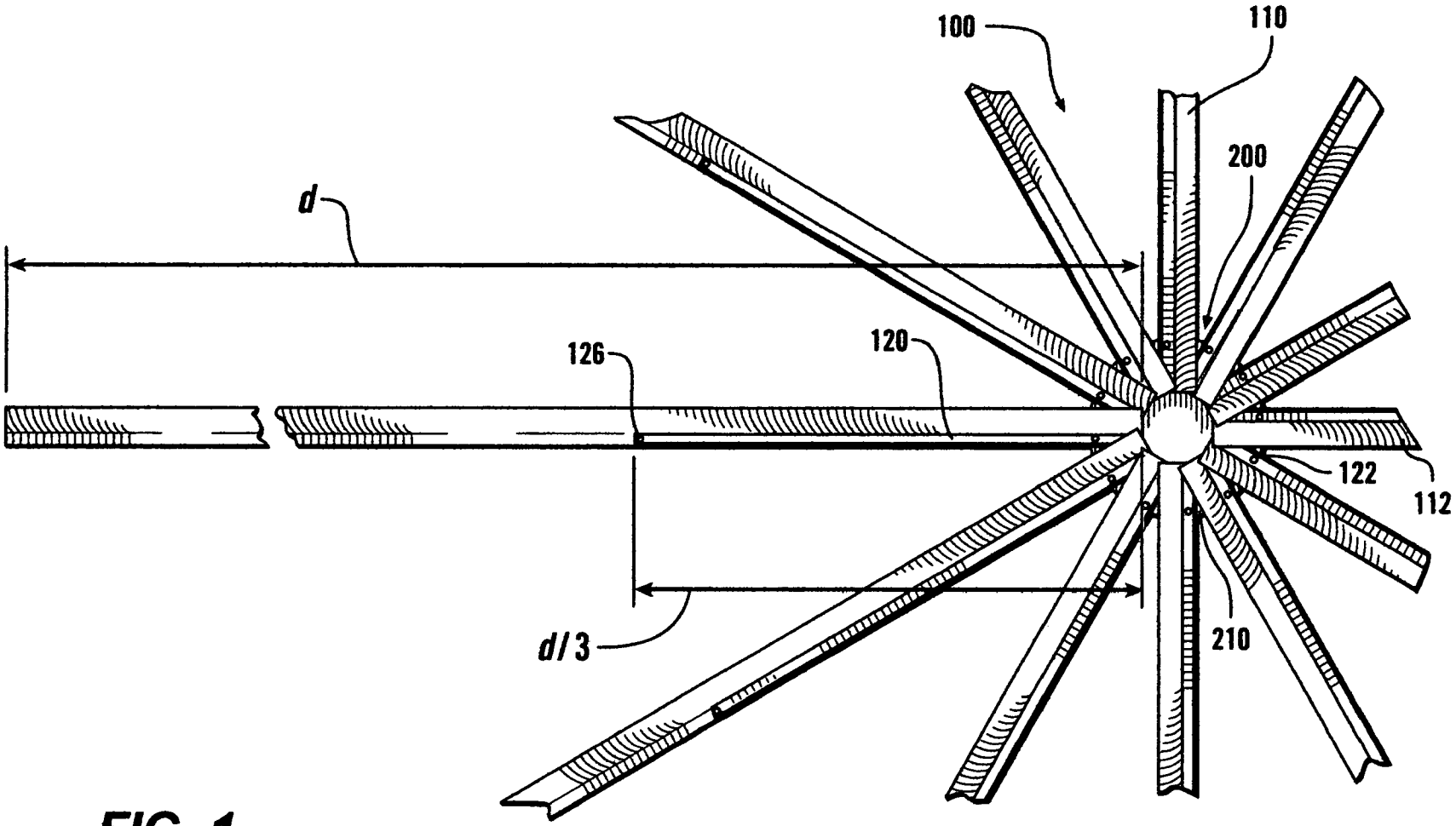
FIG. 1 is a bottom plane view of one exemplary embodiment of a fan including a fan blade hub according to this invention, and a first exemplary embodiment of a fan blade according to this invention.

FIG. 1 is a bottom plan view of one exemplary embodiment of a fan 100, including a plurality of a first exemplary embodiment of the fan blades 110 and one exemplary embodiment of a fan blade hub plate 210 according to this invention. As shown in FIG. 1, in various exemplary embodiments, the fan 100 includes 12 first exemplary fan blades 110 that extend radially from a fan blade hub assembly 200. The first exemplary fan blades 110 can be any desired length that is useful in a given application. For many typical applications, each fan blade 110 can be about 4 feet to about 8-12 feet long (approximately 1.2 meters to about approximately 2.4-3.7 meters), or longer, as discussed below. In various exemplary embodiments, the first exemplary fan blades 110 are about 96 inches long and are approximately 3-4 inches wide, but can be any desired width that allows for a generally cone-shaped region of moving air to be created.

Figure 2:
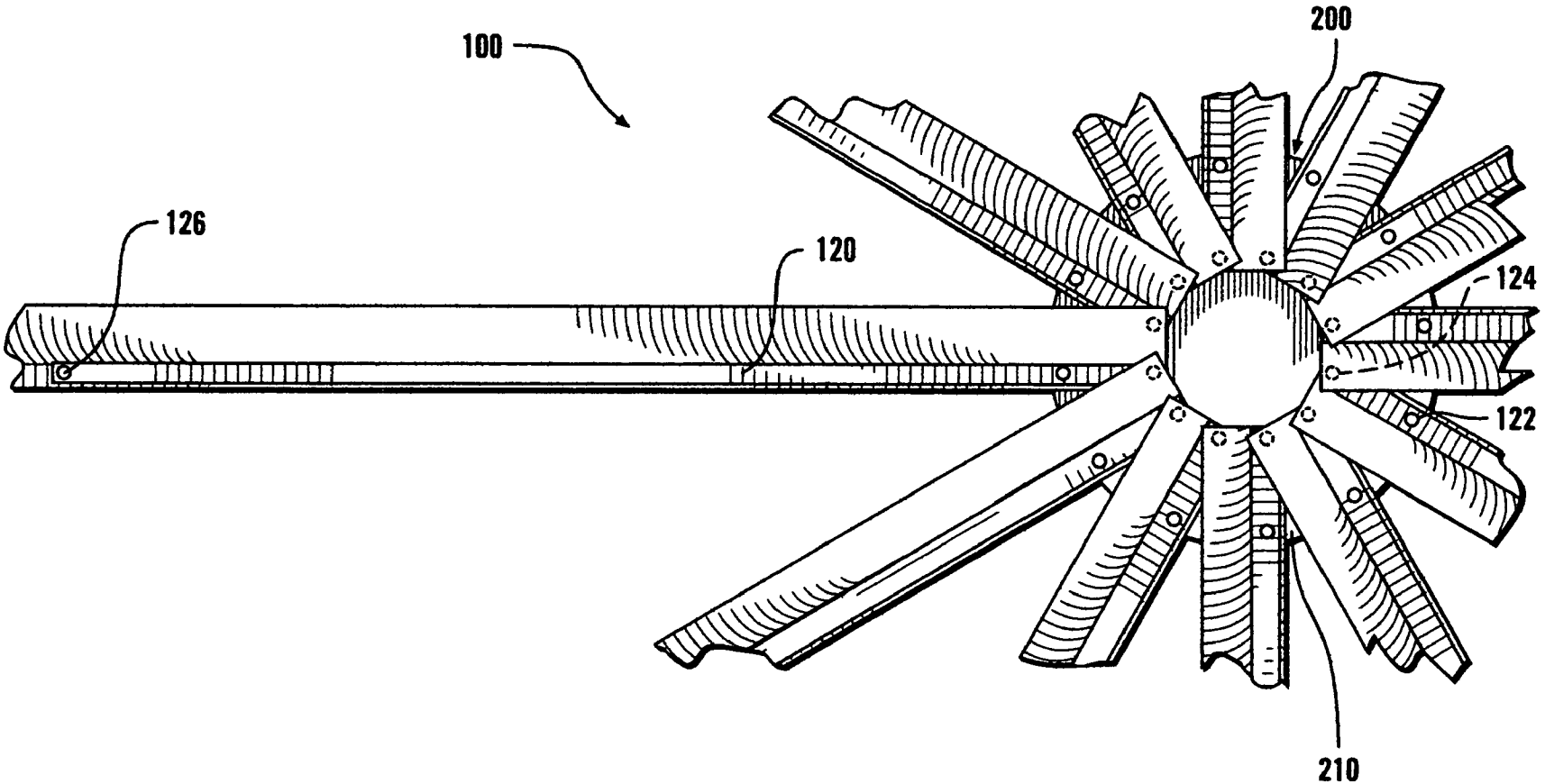
FIG. 2 is a bottom plan view of the fan of FIG. 1, showing the first exemplary embodiment of the fan blades and stiffening elements in greater detail.

As shown in FIGS. 1 and 2, in various exemplary embodiments, the first exemplary fan blades 110 are attached to the underside of the fan blade hub assembly 200. In the exemplary embodiment shown in FIGS. 1 and 2, the first exemplary fan blades 110 are bolted on to a fan blade hub plate 210 of the fan blade hub assembly 200 at two places using bolts 122 and 124. Alternatively, the first exemplary fan blades 110 can be welded or otherwise suitably attached to the fan blade hub plate 210 using any known or later developed technique. In various exemplary embodiments, a support member or stiffening element 120 is also attached to one side of each first exemplary fan blade 110. In particular, in the exemplary embodiment shown in FIGS. 1 and 2, the stiffening element 120 is attached to the underside of each first exemplary fan blade 110 using the bolts 122 and 124, as well as a third bolt 126. In this exemplary embodiment, the fan blades 110 are held between the fan blade hub plate 210 and the support members or stiffening elements 120.

It should be appreciated that, in the exemplary embodiment shown in FIGS. 1 and 2, the bolts 124 are located about one inch away from the hub end of the first exemplary fan blades 110 and about one inch behind the leading edge of the first exemplary fan blades 110. The bolts 124 are also located approximately 6-8 inches from the center of the fan blade hub plate 210. Similarly, the bolts 122 are located about one inch away from the outer edge of the fan blade hub plate 210 and about one inch behind the leading edge of the first exemplary fan blades 110. It should also be appreciated that, in the exemplary embodiments shown in FIGS. 1 and 2, the fan blade hub plate 220 is 30 inches in diameter and has a 10-inch-diameter reinforcing plate at its center that is used to attach the fan blade hub plate 210 to the spindle of a gearbox. Thus, it should be appreciated that the preceding discussion is exemplary, and different locations for the bolts 122 and 124 relative to the first exemplary fan blades 110 and the fan blade hub plate 210 can be used for the first exemplary fan blades 110 and/or fan blade hub plates 210 having different dimensions.

In the exemplary embodiment shown in FIGS. 1 and 2, the support members or stiffening elements 120 are generally rectangular prism shaped and extend approximately ⅓ of the length of the fan blades 110 along the first exemplary fan blades 110. It should be appreciated that the support members or stiffening elements 120 can be omitted if the first exemplary fan blades 110 are sufficiently stiff enough to create the cone of moving air and to reliably rotate with the fan blade hub plate 210 at the rotational speeds that the large area fan 100 is designed to operate at. In general, this will depend, at least in part, on one or more of: the designed operational rotational speeds of the large area fan 100, the size of the fan blade hub plate 210, how the first exemplary fan blades 110 are attached to the fan blade hub plate 210, the material used for the first exemplary fan blades 110, the width of the first exemplary fan blades 110, the design of the curvature of the first exemplary fan blades 110 and/or the length of the first exemplary fan blades 110.

If the support members or stiffening elements 120 are used, it should be appreciated that such support members or stiffening elements 120 are not limited to the shape and/or dimensions outlined with respect to the exemplary embodiment shown in FIGS. 1 and 2. That is, the length, width, thickness, and/or location of the first exemplary fan blades 110 and/or their connection to the support members or stiffening elements 120 can be anything that appropriately or sufficiently stiffens the first exemplary fan blades 110 to a desired value. Thus, if less stiffening is desired, the stiffening elements 120 can be shorter, narrower, thinner, made of a less stiff material and/or attached differently to the first exemplary fan blades 110 and/or the fan blade hub plate 210.

Figure 3:
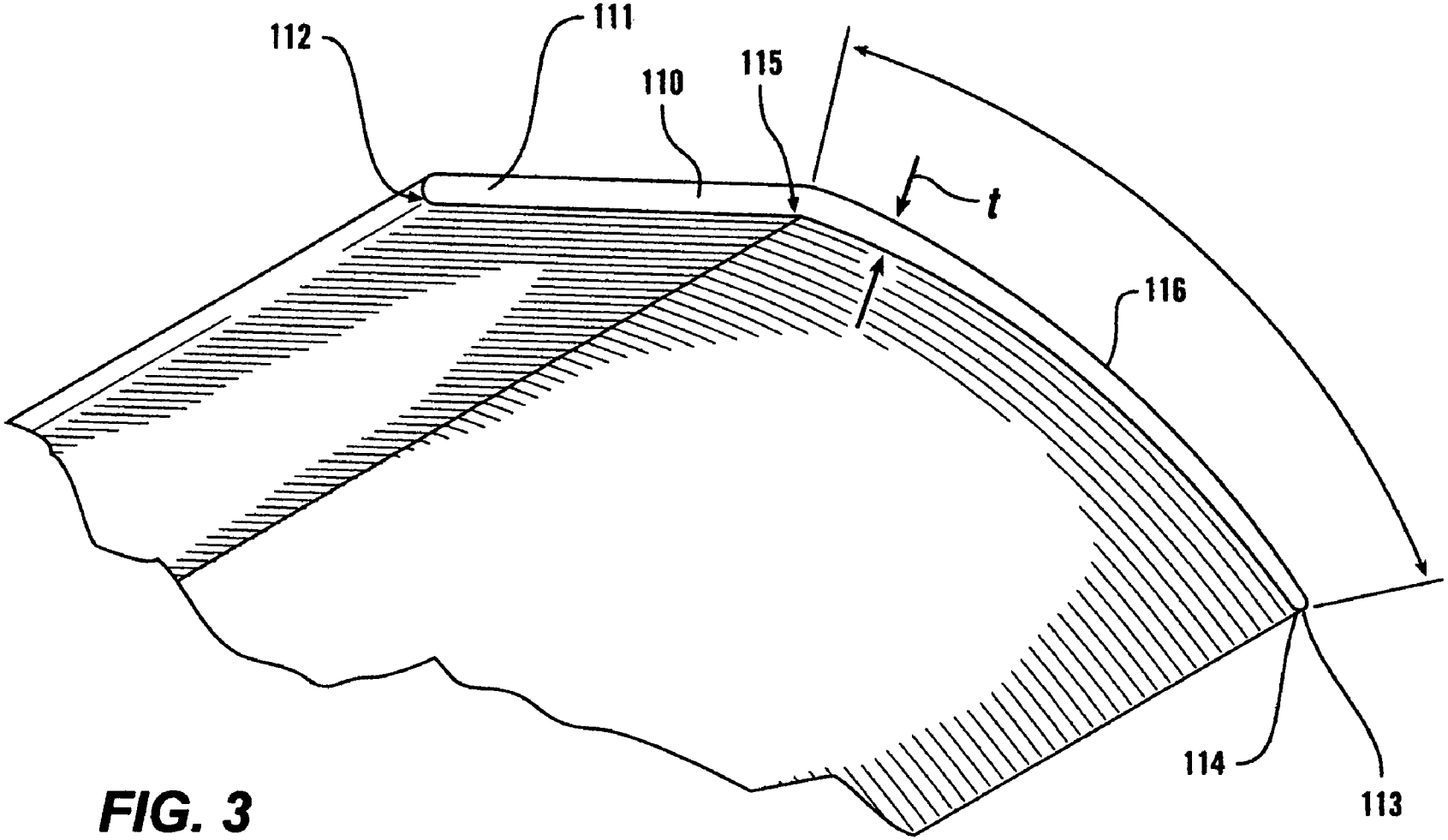
FIG. 3 is a side perspective view along the first exemplary embodiment of the fan blade according to this invention.

FIG. 3 shows the free end of one exemplary embodiment of the first exemplary fan blade 110 according to this invention. In particular, FIG. 3 shows a first exemplary fan blade 110 that was formed by extruding the fan blade material through a die. In the exemplary embodiment of the first exemplary fan blade 110 shown in FIG. 3, the leading edge 111 of the first exemplary fan blade 110 can be rounded, flat or blunt, and has a thickness of about 0.15 inches. It should be appreciated that other thicknesses for the first exemplary fan blade 110 can be used as desired, so long as the first exemplary fan blade 110 retains sufficient strength and rigidity to withstand use as a fan blade of the fan 100.

It should be appreciated that, as shown in FIGS. 1 and 2, because the first exemplary fan blades 110 are curved, the trailing edge of one first exemplary fan blade 110 can extend over the leading edge of the trailing first exemplary fan blade 110 for the portions of the first exemplary fan blades 110 that are adjacent to the fan hub plate 210.

In the exemplary embodiments outlined above, the first exemplary fan blades 110 can be obtained by extrusion or by bending a strip of sheet metal around ajig or template to obtain the curved portions 116 of the first exemplary fan blades 110. It should be appreciated that, using this last process, it is possible to apply different degrees of curvature to the strip of sheet metal as it is bent. Thus, for example, at the hub end 112 that is to be attached to the fan blade hub plate 210, the curved portion 116 of the first exemplary fan blade 110 could have a relatively smaller amount of curvature (i.e., larger radius of curvature), while at the free end 114, the curved portion 116 of the first exemplary fan blade 110 could have a relatively greater degree of curvature (i.e., smaller radius of curvature). It should further be appreciated that, when using a first exemplary fan blade 110 formed by bending a sheet of material, the curvature of intermediate portions of the curved portion 116 of the first exemplary fan blade 110 could change continuously and constantly, could change continuously but at different rates at different places along the length of the first exemplary fan blade 110, could change in discrete but constant steps or could change in discrete but differing step sizes for at least some of the steps, or even combinations of these.

In various exemplary embodiments, the curved portions 116 of the first exemplary fan blades 110 are formed as arc segments of a simple curve, such as a circle, an ellipse, a parabola or the like. In various exemplary embodiments, the curved portions 116 of the first exemplary fan blades 110 are formed as segments of a circle. In various exemplary embodiments, the first exemplary fan blades 110 are extruded using 6005 or 6061 aluminum as a starting material. The extruded first exemplary fan blades 110 can then be heat treated or aged. One exemplary set of heat treating parameters include treating the extruded first exemplary fan blades 110 for 5-9 hours at a temperature of 300°-500° F.

In various exemplary embodiments, the first exemplary fan blades are 110 extruded by first heating up a billet or log of material, such as aluminum or other material, that has sufficient strength and rigidity to be usable as a first exemplary fan blade 110 according to this invention. Such other materials can include other metals, such as iron, steel, copper, alloys of one or more of these or other metals and/or other materials, plastics, such as PVC, suitable thermosetting plastics, ceramics, composites and the like. In general, any material that can be formed into an appropriate first exemplary fan blade 110 according to this invention and that has sufficient mechanical properties that permit that material to survive as a first exemplary fan blade 110 in a fan 100 according to this invention for a suitable length of time can be used to form the first exemplary fan blades 110.

In exemplary embodiments using aluminum as a starting material, before extruding, the aluminum log or billet is heated at temperatures of about 400°-to about 500° C. (about 750° to about 1000° F.). However, it should be appreciated that this range can be extended in either direction depending on the type of aluminum. Once extruded, the aluminum first exemplary fan blades 110 are relatively soft and malleable. After the first exemplary fan blades 110 are extruded, they are aged or heat treated to reduce their malleability, and to increase their hardness and/or stiffness. In various exemplary embodiments, such as for aluminum first exemplary fan blades 110, the aging process produces a fine dispersion of alloying materials, such as magnesium and silicon, increases the strength of the extruded aluminum material.

It should be appreciated that the extruded first exemplary fan blades 110 can be of any desired width, with any desired radius of curvature for the curved portions 116, and have any desired arc length and shape for the curved portions 116. The shape, size, thickness and radius of curvature depend on the shape of the orifice on the steel die used to form the extruded first exemplary fan blade 110.

In various exemplary embodiments, the fan blades 110 are formed with the trailing edge having a slight thinning or taper and/or with the leading and trailing edges slightly rounded. Typically, the first exemplary fan blades 110 will be approximately 0.14 inch-0.16 inch thick. However, any desired thickness can be used.

In various other exemplary embodiments, the first exemplary fan blades 110 are cut and formed from a sheet of aluminum. This sheet can have any appropriate thickness and can be cut into any desired shape. The sheet can be cut so that the edges meet at right angles, i.e., square, or can be cut at an angle to create an offset between the ends of the first exemplary fan blades 110. The cut sheets are then bent around a form or jig at the desired radius for the curved portions 116. The first exemplary fan blades 110 can then be heat treated or aged as desired to improve or control their mechanical properties.

In various exemplary embodiments, such as that shown in FIG. 3, the thickness of the first exemplary fan blade 110 gradually decreases from some point at or between a leading edge 111 and a trailing edge 113. The thickness at the trailing edge 113 is, for example, 0.072 inch and, in various exemplary embodiments, is 35% to 70% of the thickness of the leading edge 111. In various exemplary embodiments, as shown in FIG. 3 the trailing edge 113 is also rounded.

Figure 4:
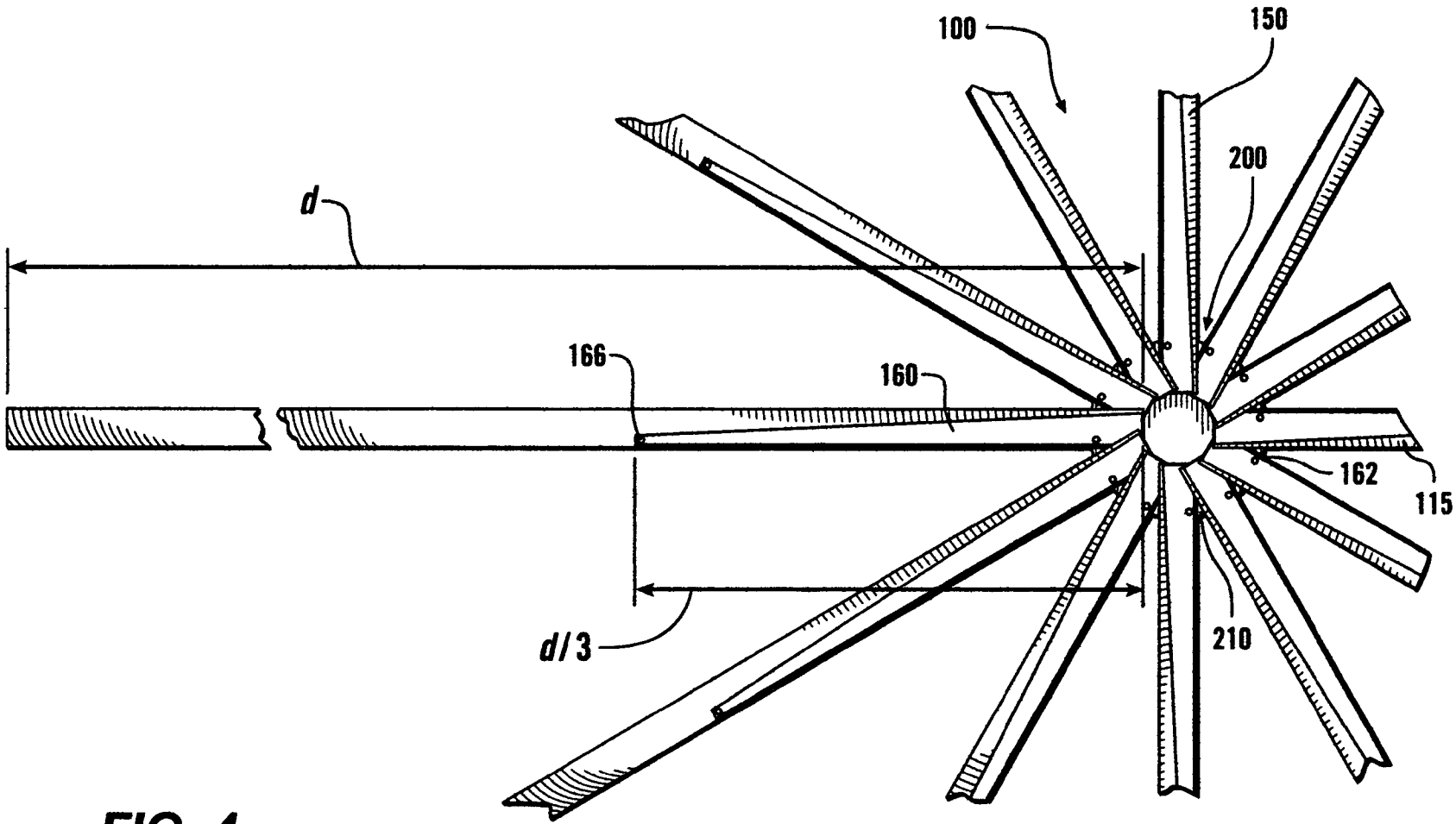
FIG. 4 is a bottom plane view of one exemplary embodiment of the fan shown in FIG. 1 that incorporates a second exemplary embodiment of the fan blade according to this invention.

FIG. 4 is a bottom plan view of one exemplary embodiment of a fan 100, including a second exemplary embodiment of a plurality of fan blades 150 and one exemplary embodiment of the fan blade hub plate 210 according to this invention. As shown in FIG. 4, the fan 100 includes 12 second exemplary fan blades 150 that extend radially from the fan blade hub assembly 200. The second exemplary fan blades 150 can be any desired length that is useful in a given application. For many typical applications, each second exemplary fan blade 150 can be about 4 feet to about 8-12 feet long (approximately 1.2 meters to about approximately 2.4-3.7 meters), or longer, as discussed below. In various exemplary embodiments, the second exemplary fan blades 150 are about 96 inches (approximately 2.4 meters) long and are approximately 4-6 inches (approximately 101.6-152.4 millimeters) wide, but can be any desired width that allows for a generally cone-shaped region of moving air to be created.

Figure 5:
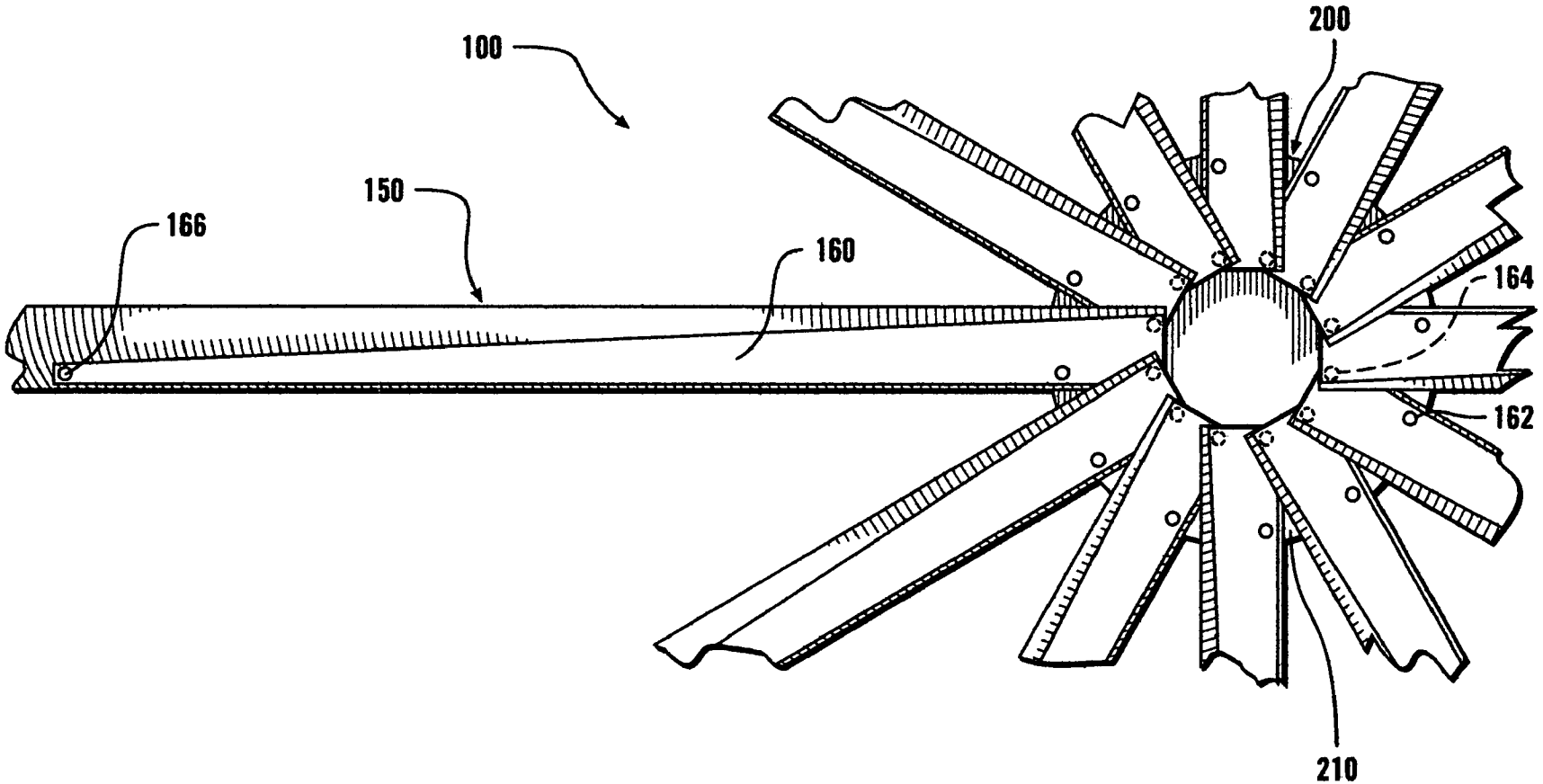
FIG. 5 is a bottom plan view of the fan of FIG. 4, showing the second exemplary embodiment of the fan blades and stiffening elements in greater detail.

As shown in FIGS. 4 and 5, in various exemplary embodiments, the second exemplary fan blades 150 are attached to the underside of the fan blade hub assembly 200. In the exemplary embodiment shown in FIGS. 4 and 5, the second exemplary fan blades 150 are bolted on to the fan blade hub plate 210 at two places using bolts 162 and 164. Alternatively, the second exemplary fan blades 150 can be welded or otherwise suitably attached to the fan blade hub plate 210 using any known or later developed technique. In various exemplary embodiments, a second exemplary support member or stiffening element 160 is also attached to one side of each second exemplary fan blade 150. In particular, in the exemplary embodiment shown in FIGS. 4 and 5, the stiffening element 160 is attached to the underside of each fan blade 150 using the bolts 162 and 164, as well as a third bolt 166. In this exemplary embodiment, the second exemplary fan blades 150 are held between the fan blade hub plate 210 and the support members or stiffening elements 160.

It should be appreciated that, in the exemplary embodiment shown in FIGS. 4 and 5, the bolts 164 are located about one inch (approximately 25.4 millimeters) away from the hub end of the second exemplary fan blades 150 and about one inch (approximately 25.4 millimeters) behind the leading edge of the second exemplary fan blades 150. The bolts 164 are also located approximately 6-8 inches (approximately 152.4-203.2 millimeters) from the center of the fan blade hub plate 210. Similarly, the bolts 162 are located about one inch (approximately 25.4 millimeters) away from the outer edge of the fan blade hub plate 210 and about one inch (approximately 25.4 millimeters) behind the leading edge of the second exemplary fan blades 150. It should also be appreciated that, in the exemplary embodiments shown in FIGS. 4 and 5, the fan blade hub plate 220 is 30 inches (approximately 762 millimeters) in diameter and has a 10-inch-diameter (approximately 254 millimeters) reinforcing plate at its center that is used to attach the fan blade hub plate 210 to the spindle of a gearbox. Thus, it should be appreciated that the preceding discussion is exemplary, and different locations for the bolts 162 and 164 relative to the second exemplary fan blades 150 and the fan blade hub plate 210 can be used for second exemplary fan blades 150 and/or fan blade hub plates 210 having different dimensions.

In the exemplary embodiment shown in FIGS. 4 and 5, the support members or the stiffening elements 160 extend approximately ⅓ of the length along the second exemplary fan blades 150 and taper toward the leading edge of the second exemplary fan blades 150. It should be appreciated that the support members or stiffening elements 160 can be omitted if the second exemplary fan blades 150 are sufficiently stiff enough to create the cone of moving air and to reliably rotate with the fan blade hub plate 210 at the rotational speeds that the large area fan 100 is designed to operate at. In general, this will depend, at least in part, on one or more of: the designed operational rotational speeds of the large area fan 100, the size of the fan blade hub plate 210, how the second exemplary fan blades 150 are attached to the fan blade hub plate 210, the material used for the second exemplary fan blades 150, the width of the second exemplary fan blades 150, the design of the curvature of the second exemplary fan blades 150 and/or the length of the second exemplary fan blades 150.

If the support members or stiffening elements 160 are used, it should be appreciated that such support members or stiffening elements 160 are not limited to the shape and/or dimensions outlined with respect to the exemplary embodiment shown in FIGS. 4 and 5. That is, the length, width, thickness, and/or location of the second exemplary fan blades 150 and/or their connection to the support members or stiffening elements 160 can be anything that appropriately or sufficiently stiffens the second exemplary fan blades 150 to a desired value. Thus, if less stiffening is desired, the stiffening elements 160 can be shorter, narrower, thinner, made of a less stiff material and/or attached differently to the second exemplary fan blades 150 and/or the fan blade hub plate 210.

Figure 6:
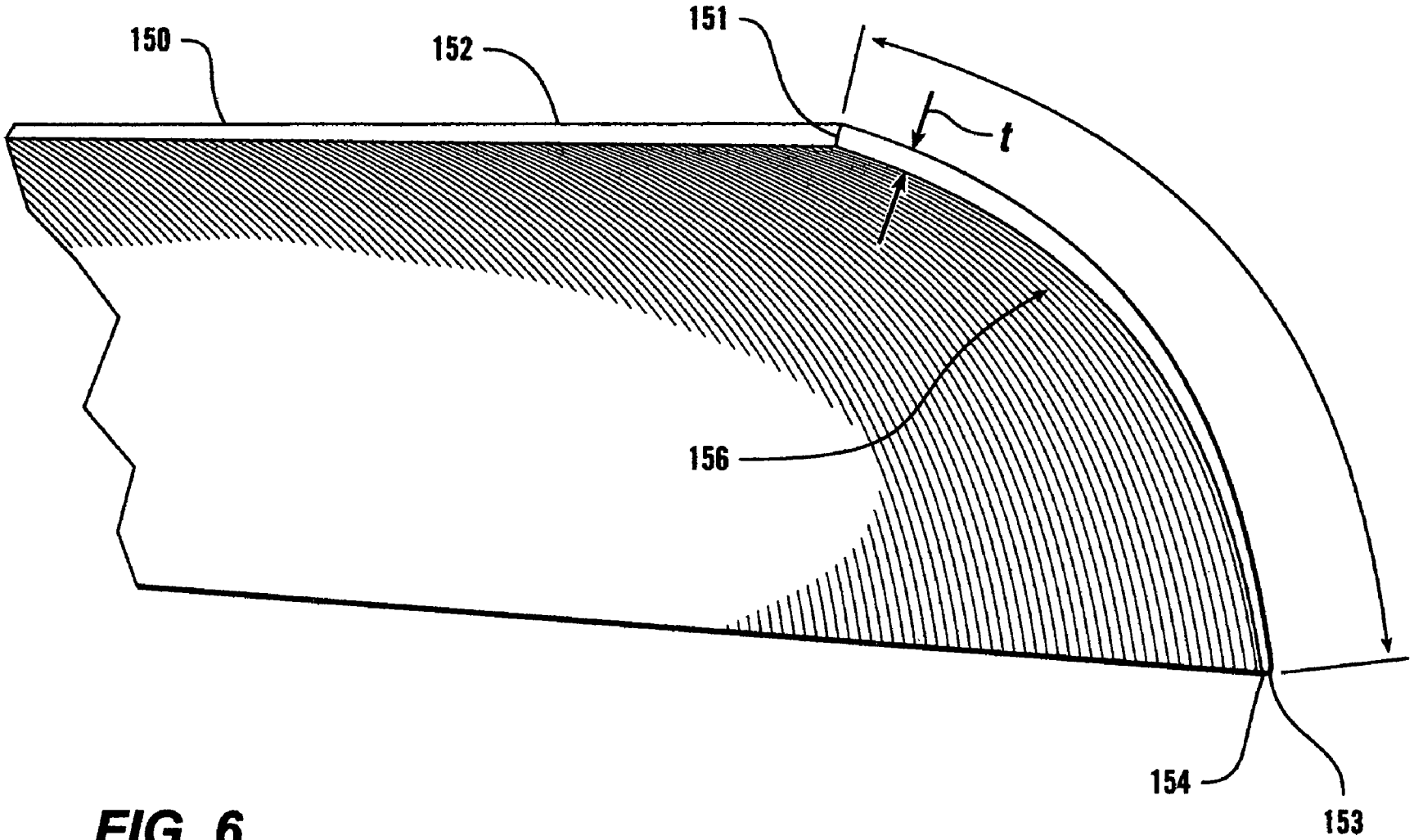
FIG. 6 is a side perspective view along the second exemplary embodiment of the fan blade according to this invention.

FIG. 6 shows the free end of one exemplary embodiment of a second exemplary fan blade 150 according to this invention. In particular, FIG. 6 shows a second exemplary fan blade 150 formed by extruding the fan blade material through a die. In the exemplary embodiment of the second exemplary fan blade 150 shown in FIG. 6, the leading edge 151 of the second exemplary fan blade 150 can be rounded, flat or blunt, and has a thickness of about 0.15 inches (approximately 3.81 millimeters). It should be appreciated that other thicknesses for the second exemplary fan blade 150 can be used as desired, so long as the second exemplary fan blade 150 retains sufficient strength and rigidity to withstand use as a second exemplary fan blade 150 of the fan 100.

It should be appreciated that, as shown in FIGS. 4 and 5, because the second exemplary fan blades 150 are curved, the trailing edge of one second exemplary fan blade 150 can extend over the leading edge of the trailing second exemplary fan blade 150 for the portions of the second exemplary fan blades 150 that are adjacent to the fan hub plate 210.

In the exemplary embodiments outlined above with respect to FIGS. 4-6, the second exemplary fan blades 150 can be obtained by extrusion or by cutting a pipe of constant curvature into sections. As also outlined above, a third exemplary method for obtaining the second exemplary fan blades 150 is to bend a strip of sheet metal around a jig or template to obtain a curved second exemplary fan blade 150. It should be appreciated that, using this last process, it is possible to apply different degrees of curvature to the strip of sheet metal as it is bent. Thus, for example, the hub end 152 of the second exemplary fan blade 150 that is to be attached to the fan blade hub plate 210 could have a relatively smaller amount of curvature (i.e., larger radius of curvature), while the free end 154 of the second exemplary fan blade 150 could have a relatively greater degree of curvature (i.e., smaller radius of curvature). It should further be appreciated that, when using a second exemplary fan blade 150 formed by bending a sheet of material, the curvature of intermediate portions of the second exemplary fan blade 150 could change continuously and constantly, could change continuously but at different rates at different places along the length of the second exemplary fan blade 150, could change in discrete but constant steps or could change in discrete but differing step sizes for at least some of the steps, or even combinations of these.

For second exemplary fan blades 150 that are obtained by cutting an 8-inch (approximately 203.2 millimeters) (nominal) inside diameter pipe into six equal portions, due to the saw blade kerf, the second exemplary fan blades 150 have an arc length of, for example, 58.5 degrees. As indicated above, the ends of the second exemplary fan blades 150 are offset circumferentially. In various exemplary embodiments, for second exemplary fan blades 150 that are approximately 96 inches (approximately 2.4 meters) long, an offset of approximately 1 inch (approximately 25.4 millimeters) is appropriate. This results in the second exemplary fan blades 150 being not quite at right angles between the long and short edges. In various exemplary embodiments, for 96-inch (approximately 2.4 meters) second exemplary fan blades 150 with a one-inch (approximately 25.4 millimeters) offset, the edges meet at 89.4 or 90.6 degree angles.

The support members or stiffening elements 160 can be formed using the same technique as for the second exemplary fan blades 150. For example, when extruding a 96-inch (approximately 2.4 meters) fan blade, a 96-inch (approximately 2.4 meters) support member extrusion will also be formed. After twisting, and heat treating or aging, the support member extrusion is then cut into three approximately 3, 30 to 32-inch (approximately 762 to approximately 812.8 millimeters) segments. These segments are then cut lengthwise to create at least three support members or stiffening elements 160.

In various exemplary embodiments, the support members or stiffening elements 160 can be formed by cutting each of the support member extrusion segments roughly in half, roughly along a diagonal of the segment. However, it should be appreciated that the support members or stiffening elements 160 are not necessarily, nor even usually, formed by simply cutting along the diagonal. For example, the support members or stiffening elements 160 can be formed by starting the cut into the segment at one end of the segment and about 20%-25% in from the trailing or leading edge and cutting to the other end through a point that is an approximately equal amount in from the leading or trailing edge respectively.

Assuming that the fan blade extrusion section does not have a tapering thickness towards the trailing edge or smaller feature, the section is thus cut into two equal portions, such that 6 support members or stiffening elements 160 can be obtained from one such extrusion. However, if the extruded second exemplary fan blades 150 have a tapering thickness and/or a rounded or feathered trailing edge, the portions of the segments containing the trailing edge of the extrusion may not be usable as stiffening elements or support members 160. If not usable, those portions of the segments will typically be discarded s scrap.

Additionally, it should be appreciated that, in the exemplary embodiments shown in FIGS. 4-6, due to the offset between the ends of the fan blades 150, the portions of the second exemplary fan blades 150 held against the fan hub plate 210 are held against the fan blade hub plate 210 in a slightly more horizontal position than the position of the portions of the second exemplary fan blades 150 that are distant from the fan blade hub plate 210. Thus, the second exemplary fan blades 150 tend to present a larger profile to the air at the portions of the second exemplary fan blades 150 that are distant from the fan hub plate 210. This tends to cause air to spill out of the far end of the fan blades 110 as the second exemplary fan blades 150 rotate with the fan 100.

In various exemplary embodiments, the second exemplary fan blades 150 are formed as arc segments of a simple curve, such as a circle, an ellipse, a parabola or the like. In various exemplary embodiments, the second exemplary fan blades 150 are formed as segments of a circle. While this circle can have any desired radius, one particularly useful second exemplary fan blade 150 is formed as an approximately 60° arc length segment of an 8-inch (approximately 203.2 millimeters) circle. It should be appreciated that this circle radius is typically measured from the inside surface of the second exemplary fan blade 150, but could be measured from the outside surface. It should also be appreciated that the second exemplary fan blades 150 can have any arc length that allows for a generally cone-shaped region of moving air to be created.

In various exemplary embodiments, the second exemplary fan blades 150 are extruded using 6005 or 6061 aluminum as a starting material. In various exemplary embodiments, after being extruded, the second exemplary fan blades 150 are twisted along their axis such that the free end of the second exemplary fan blades 150 are offset from the hub ends of the second exemplary fan blades 150 in the opposite direction from the direction of rotation. Any desired amount of offset can be used. However, in general, the larger the amount of offset, the greater the radial air flow will be. The extruded second exemplary fan blades 150 can then be heat treated or aged. One exemplary set of heat treating parameters include treating the extruded second exemplary fan blades 110 for 5-9 hours at a temperature of 300°-500° F.

In exemplary embodiments using aluminum as a starting material, before extruding, the aluminum log or billet is heated at temperatures of about 400°-to about 500° C. (about 750° to about 1000° F.). However, it should be appreciated that this range can be extended in either direction depending on the type of aluminum. Once extruded, the aluminum second exemplary fan blades 150 are relatively soft and malleable. Consequently, the second exemplary fan blades 150 are easily twisted to create the desired offset between the hub and free ends of the second exemplary fan blades 150. In various exemplary embodiments, the second exemplary fan blades 150 are twisted using a fan blade twisting machine specifically designed for that purpose. However, it should be appreciated that any device usable to twist the second exemplary fan blades 150 according to this invention can be used.

After the second exemplary fan blades 150 are twisted, they are aged or heat treated to reduce their malleability, and to increase their hardness and/or stiffness. In various exemplary embodiments, such as for aluminum second exemplary fan blades 150, the aging process produces a fine dispersion of alloying materials, such as magnesium and silicon, increases the strength of the extruded aluminum material.

It should be appreciated that the extruded second exemplary fan blades 150 can be of any desired width, with any desired radius of curvature, and have any desired arc length and shape. The shape, size, thickness and radius of curvature depend on the shape of the orifice on the steel die used to form the extruded fan blade.

In various exemplary embodiments, the second exemplary fan blades 150 are formed with the trailing edge having a slight thinning or taper and/or with the leading and trailing edges slightly rounded. Typically, the second exemplary fan blades 150 will be approximately 0.14 inch-0.16 inch (approximately 3.6 to approximately 4.1 millimeters) thick. However, any desired thickness can be used.

In various other exemplary embodiments, the second exemplary fan blades 150 are cut from a sheet of aluminum. This sheet can have any appropriate thickness, and can be cut into any desired shape. The sheet can be cut so that the edges meet at right angles, i.e., square, or can be cut at an angle to create an offset between the ends of the second exemplary fan blades 150. The cut sheets are then bent around a form or jig at the desired radius. The second exemplary fan blades 150 can then be heat treated or aged as desired to improve or control their mechanical properties. It should be appreciated that, if the sheets are cut square, after bending the square-cut sheet, the resulting second exemplary fan blades 150 can be twisted to offset one end relative to the other using the fan blade twisting machine described above.

In various other exemplary embodiments, the second exemplary fan blades 50 are formed by cutting an 8-inch (approximately 203.2 millimeters) (nominal) inside diameter schedule-10 (6063) aluminum pipe. The outer diameter of the pipe is approximately 8.3 inches (approximately 210.8 millimeters), and the thickness of the pipe is approximately 0.148 inches (approximately 3.76 millimeters). The pipe is cut axially, i.e., along, rather than across, the axis into 6 second exemplary fan blades 150, with each second exemplary fan blade 150 extending in an arc that is approximately 56-60 degrees wide, depending on the kerf thickness. It should be appreciated that, in various exemplary embodiments, the second exemplary fan blades 150 are not cut straight down the pipe, but cut with a slight spiral, so that the free end of the resulting second exemplary fan blade 150 is off set relative to the hub end. That is, one end of the second exemplary fan blade 150 is offset circumferentially relative to the other end by a small amount. In various exemplary embodiments, this offset is approximately one inch (approximately 25.4 millimeters) along the circumference for a 96-inch (approximately 2.4 meters) long fan blade 150, although any desired offset amount can be used.

As indicated above, it should be appreciated that the second exemplary fan blades 150 can be formed by appropriately bending a metal sheet of suitable thickness, width and length. For example, an exemplary aluminum sheet that is between 0.1" and 0.2" thick can be cut into strips that are between 4 and 5 inches (approximately 101.6 and approximately 127 millimeters) wide and of a desired length. These sheet metal strips can then be bent against a form or jig that imparts one or more suitable curves to the sheet metal strip. In some exemplary embodiments of such a fan blade 150, this exemplary fan blade 150, when having the above-outlined dimensions, can have approximately the same shape as the second exemplary fan blades 150 outlined above that are cut from the 8-inch (approximately 203.2 millimeters) (nominal) inside diameter schedule-10 aluminum pipe.

It should further be appreciated that the metal pipe or metal sheet need not be made of aluminum, or even metal. Rather, any other suitable metal, such as iron, steel, stainless steel, copper or the like could be used. Furthermore, any suitable non-metal material, such as plastic, such as PVC pipe, or the like can be used in place of the aluminum pipe or sheet. It should be appreciated that, in general, any material that can reliably withstand the stresses of being used as a first or second exemplary fan blade 110 or 150 in a large area fan 100 according to this invention over a sufficiently long period of time is suitably usable for the fan blades 110 or 150.

In various exemplary embodiments, such as that shown in FIG. 6, the thickness of the second exemplary fan blade 150 gradually decreases from some point at or between the leading edge 151 to a trailing edge 153. The thickness at the trailing edge 153 is, for example, 0.072 inch (approximately 1.83 millimeters) and, in various exemplary embodiments, is 35% to 70% of the thickness of the leading edge 151. In various exemplary embodiments, the trailing edge 153 is also rounded, as shown in FIG. 6.

In the exemplary embodiment shown in FIG. 6, the second exemplary fan blade 150 has a nominal arc length of 60° and a nominal radius of curvature of 4 inches (approximately 101.6 millimeters). Thus, the second exemplary fan blade 150 has a nominal width of 4.19 inches (approximately 106.4 millimeters) ($2 \cdot 4 \cdot \pi/6$) at its inner face 156 and a nominal width of 4.34 inches (approximately 110.2 millimeters) ($2 \cdot 4.148 \cdot /6$) at its outer surface 158. It should be appreciated that the second exemplary fan blades 150, if designed for a nominal arc length of 60°, can have actual arc lengths between, for, example, at least about 55° and up to about 65° or more. This occurs at least in part due to the method of manufacturing and the method for offsetting the free end relative to the hub end. For example, when extruding the second exemplary fan blade 150, the second exemplary fan blade 150 does not need to be exactly 60°. Rather, the second exemplary fan blade 150 can have any arc length that allows a sufficiently conical air flow from the fan 100. Similarly, when cutting the second exemplary fan blade 150 from an 8-inch (approximately 203.2 millimeters) (nominal) inside diameter pipe, a kerf equal to the thickness of the cutting blade will be lost, which could be up to 1°-2° of the arc width of the second exemplary fan blade 150. It should also be appreciated that any desired arc length could be used, especially when extruding the second exemplary fan blades 150.

In the exemplary embodiments shown in FIGS. 1, 2, 4 and 5, the fan 100 includes 12 fan blades 110 or 150. In general, the fan 100 can use any desired number of fan blades 110 or 150. However, the fan 100 will typically have at least two fan blades 110 or 150 for balancing purposes. The maximum number of fan blades 110 or 150 will generally depend on the length of the fan blades 110 or 150, the thickness of the fan blades 110 or 150, the radial distance, that the ends of the fan blades 110 or 150 lie at on the fan hub plate 210, and the amount of overlap between adjacent fan blades 110 or 150, if any. It should be appreciated that, for any given fan blade hub assembly 200, there will be a maximum fan blade weight that the fan blade hub assembly 200 will be designed to safely support, a maximum amount of torque that a motor and a gear box (discussed below) can safely apply to the fan blades 110 or 150, and a maximum amount of angular stress that the fan blade hub assembly 200 is safely designed to withstand.

That is, the fan blade hub assembly 200 is typically designed to support a maximum dead weight of the fan blades 110 or 150. Similarly the fan blade hub assembly 200 is typically designed to output a maximum amount of torque to the fan blade hub plate 210 and thus to the fan blades 110 or 150. Additionally, as the fan blades 110 or 150 rotate, significant forces are applied to the fan blades 110 or 150 by the air as it is moved by the fan blades 110 or 150. Due to lever arm action, this force can increase significantly as the length of the fan blades 110 or 150 increases. This force is directly translated to the fan blade hub plate 210 and thus to the gearbox and the motor of the fan blade hub assembly 200.

In general, due to those factors, a particular fan 100 will have a given blade length that generally should not be exceeded for a given full number of blades that that fan 100 is designed to use. To go beyond this given blade length, a number of the fan blades may be removed and/or the rotational speed of the fan may be decreased. For example, for a 12-blade fan 100 designed to use up to 8-ft fan blades 110 or 150, to use 12-foot (approximately 3.7 meters) fan blades 110 or 150, the number of fan blades 110 or 150 may be reduced to 9, 8, 6 or even 4 blades, and/or the rotational speed of the fan 100 may be reduced. In general, the number of fan blades 110 or 150 that are removed should be selected to keep the fan blades 110 or 150 in balance around the fan blade hub assembly 200.

Similarly, to go beyond this given blade length or to add additional fan blades, the sizes of one or both of the gearbox and/or the motor may be increased and/or the rotational speed of the fan 100 may be decreased. In general, for a given combination of motor and gearbox, the number of fan blades 110 and/or 150 and the rotational speed of the fan 100 can be adjusted to keep the fan 100 operating within the limits of the motor and gearbox. Alternatively, if a particular number of fan blades 110 and/or 150 and a particular fan blade length is desired, a different gearbox and/or motor having larger size (s), which are sufficient for the desired number of fan blades 110 and/or 150 and/or fan blade length, can be used with the fan 100.

For example, for a 16-blade fan 100 having 8-foot (approximately 2.4 meters) fan blades 110 and/or 150, i.e., a "17-foot" fan 100, the fan 100 can use a 2 hp motor and a larger, 70-rpm gearbox. Such a fan 100 having this number and length of fan blades 110 and/or 150 will generally move approximately twice as much air as a fan 100 having 12 8-foot (approximately 2.4 meters) long fan blades 110 and/or 150. In general, it is possible for a fan 100 according to this invention having 12-foot (approximately 3.7 meters) long fan blades 110 or 150, i.e., a "25-foot" fan 100, to have between 6 and 16 blades given the appropriate sizes for the fan blade hub 200, the motor 250 and the gearbox 230.

It should also be appreciated that the dimensions of the fan blades 110 or 150 and the fan blade hub plate 210 and the number of fan blades 110 or 150 are not limited to those used in the exemplary embodiments outlines above. In general, there is an inverse relationship between the width of the fan blades 110 or 150 and the maximum number of fan blades 110 or 150. That is, generally, but not necessarily, as the fan blades 110 get larger or smaller, fewer or more fan blades 110 or 150, respectively, can be used in a large area fan 100 according to this invention. In general, this relationship will depend in part on the amount of overlap between adjacent fan blades 110 or 150, which in turn depends on the degree of curvature and/or shape of the fan blades 110 or 150 at the fan blade hub plate 210, as this generally controls how much overlap there can be between adjacent fan blades 110 or 150 at the fan blade hub plate 210.

It should also be appreciated that the dimensions of the fan blade hub plate 210 and the locations of the bolts 122 or 162 and 124 or 164 relative to the fan blades 110 or 150, respectively, and the fan blade hub plate 210 are not limited to those set forth in the above-outlined exemplary embodiments. That is, for example, the fan blade hub plate 210 could be larger or smaller than that outlined above. The fan blade hub plate 210 will generally be sized to securely and reliably hold the fan blades 110 so that the fan blades 110 can be rotated at appropriate rotational speeds to move an appropriate column of air in the large space in which the large area fan 100 is installed.

Figure 7:
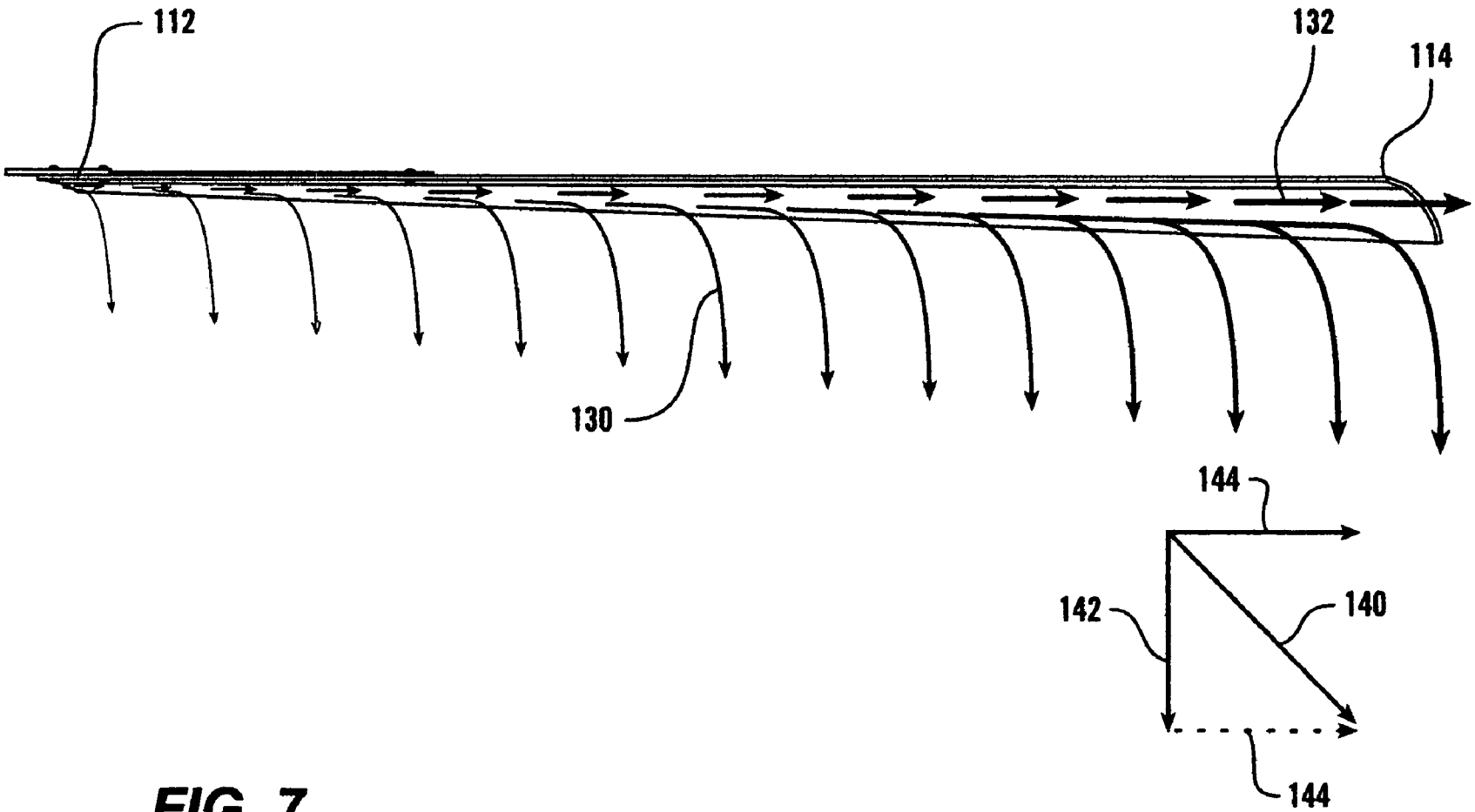
FIG. 7 illustrates the flow of air that occurs when the first exemplary embodiment of the fan blades according to this invention rotate.
Figure 8:
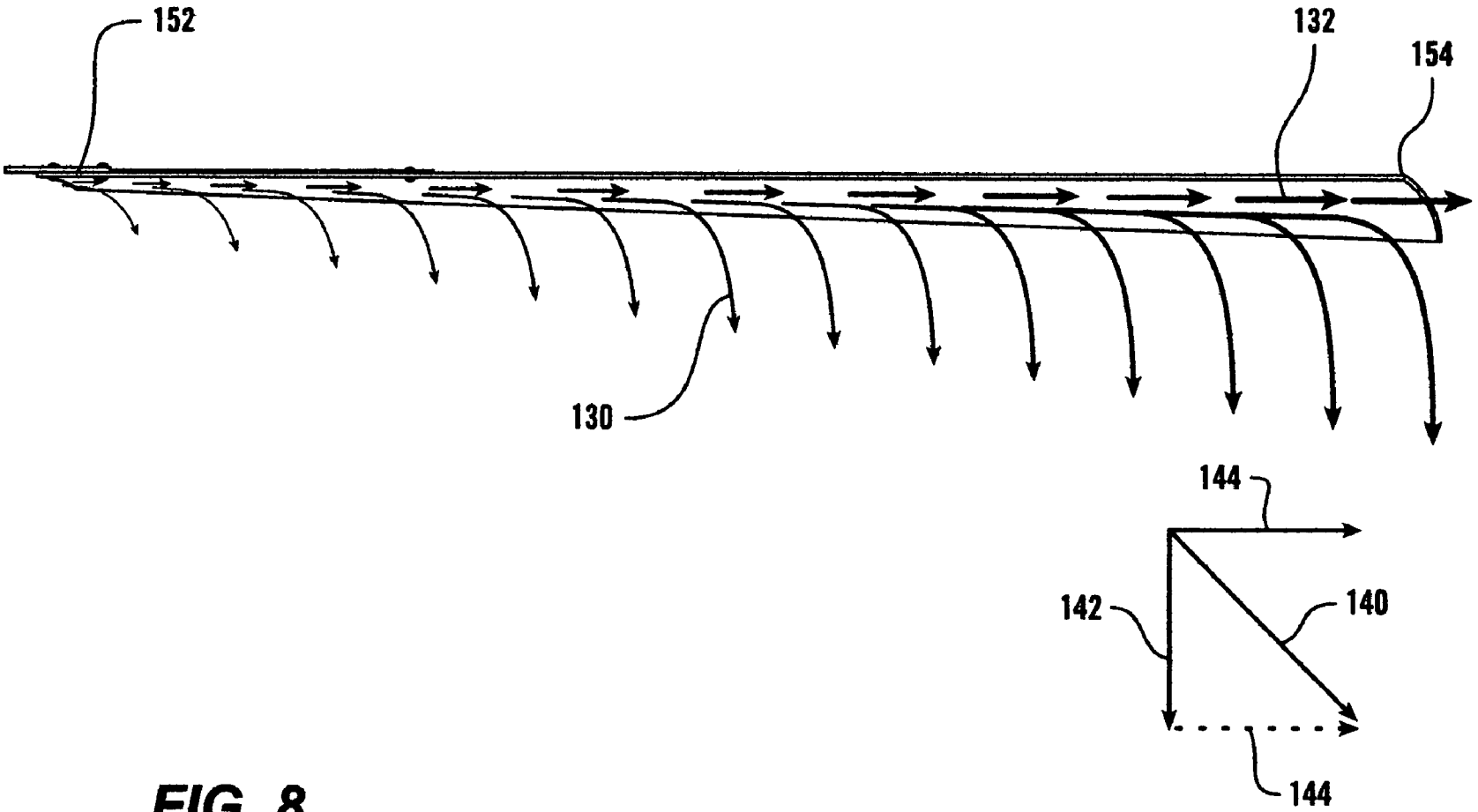
FIG. 8 illustrates the flow of air that occurs when the second exemplary embodiment of the fan blades according to this invention rotate.

Unlike traditional fan blades that are shaped like propellers or airfoils, the fan blades 110 and 150 do not push, force or displace all of the air that contacts the fan blades 110 and 150 in a downward direction. Instead, as shown in FIGS. 7 and 8, due to the concave shape of the fan blades 110 and 150, respectively, while a not insubstantial portion 130 of the air scooped up by the fan blades 110 is redirected downwardly, another portion 132 of the air begins to travel radially outwardly from the fan blade hub plate 210 along the fan blade 110. It should also be appreciated that, as the distance of a given portion of a fan blade 110 from the fan blade hub plate 210 increases, the linear (not rotational) speed of that portion of the fan blade 110 in the plane of rotation increases relative to air that is stationary along the plane of rotation. Additionally, with respect to the second exemplary fan blades 150, because the profile of the second exemplary fan blades 150 becomes increasingly perpendicular to the plane of rotation of the fan blades 110 when moving from the hub end 152 to the free end 154 of the fan blades 150, the increasingly distant portions of the fan blades 150 scoop out increasing amounts of air, while also acting to better contain the radially-flowing air arriving from the closer portions of the fan blades 110.

As a result of one or more of these factors, while not in a significant portion 130 of the air contacted by the fan blades 110 and 150 is directed downwardly, a portion 132 of the air moved by the fan blades 110 and 150 is directed radially along the fan blades 110 and 150. That is, there is a vector flow 142 of air downward from the fan blades 110 and 150 and a vector flow 144 of air radially along the fan blades 110 and 150. The net effect, due to the sum of these two vector air flows, is a vector flow 140 of air that extends downwardly at an outward angle from the fan blades 110 and 150, as shown in FIGS. 7 and 8, respectively. Because the fan blades 110 and 150 sweep out a circle in the plane of rotation, as the downward and outward vector flows 142 and 144 of air from the fan blades 110 and 150 are similarly swept out, the overall flow 140 of air from the fan blades 110 and 150 is in the shape of a truncated cone extending from the plane of rotation of the fan blades 110 or 150.

That is, the air moved by the fan blades 110 and 150 has both a downward vector 142 and an outward 144 vector, causing the air to move from the fan 100 in the shape of a cone. Accordingly, the fan 100 is able to move air through an area that is larger in diameter than the diameter of a circle swept out by the fan blades 110 or 150. As a result, relative to conventional fans used to move air in large spaces, the fan 100 can use smaller fan blades 110 or 150 to move air through the same area as a larger fan blade or similar sized fan blades 110 or 150 can be used to move air over a larger area.

It should also be appreciated that, relative to conventional fan blades that are shaped like air foils or like propellers, the fan blades 110 and 150 scoop out and redirect a larger volume of air. Thus, the fan blades 110 and 150 tend not only to move air over a larger area, but also move a larger amount of air.

Thus, it should be appreciated that, depending on one or more of the area to be covered by one or more large area fans 100 according to this invention, the number of such large area fans 100 to be used, and the desired amount of moving air per unit area, the number of such large area fans 100 and/or the amount of offset provided to the fan blades 110 or 150 can be adjusted to increase or decrease the area coverage of each large area fan 100, the number of large area fans 100 needed to cover a given area and/or the air flow per unit area of coverage to desired values.

In the exemplary embodiments shown in FIGS. 4-6 and 8, the profile of the fan blade 150 changes to present the width of the fan blade 150 that is at least at an increasing angle to the plane of rotation. In the exemplary embodiments outlined above with respect to FIGS. 4-6 and 8, this increasing profile is due to the offset or twist applied along the axis of the fan blades 150. It should be appreciated that, as the amount of offset increases, the rate of change of the profile increases and the maximum amount of change increases. It is believed that this tends to increase the size of the radial vector flow 144, which in turn increases the angle at which the conical flow 140 leaves the fan blades 150, relative to the axis of the fan 100. This tends to increase the area coverage of the large area fans 100 according to this invention.

Referring to FIG. 8 in particular, it should be appreciated that, in the exemplary embodiment described above, the varying profile presented by the fan blades 150 results from the twist in the fan blades 150. As shown in FIG. 8, due to this varying profile, portions of the fan blades 150 that are distant from the fan blade hub plate 210 tend to scoop up or collect more air than do the portions of the fan blades 150 that are closer to the fan hub plate 210.

Figure 9:
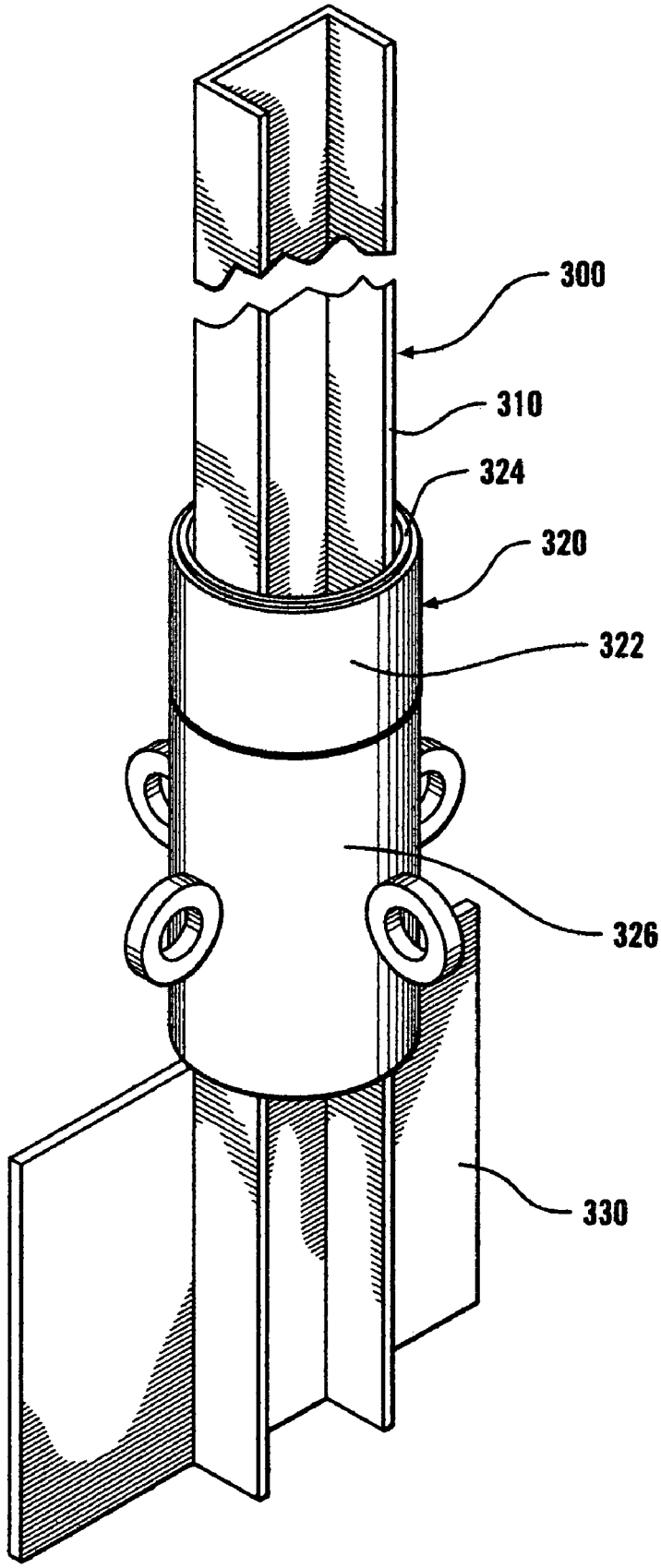
FIG. 9 is a side perspective view of one exemplary embodiment of a support structure according to this invention.

FIG. 9 shows one exemplary embodiment of a support structure 300 usable with the large area fan 100 according to this invention. The support structure 300 is typically attached at one end to a rafter, a ceiling joist or other structure of the building or other space in which the large area fan 100 is to be located that is capable of supporting the weight and forces of the large area fan 100.

As shown in FIG. 9, the support structure 300 includes a channel iron, rod or other long support member 310 that is capable of supporting the weight of the large area fan 100 and that is capable of withstanding the rotational forces generated by the large area fan 100 as it rotates. In the exemplary embodiment shown in FIG. 9, the support member 310 is a u-shaped channel iron. As shown in FIG. 9, a sleeve assembly 320 is located near one end of the support member 310 just above a mounting plate 330 that is located at the end of the support member 310. This mounting plate 330 is typically permanently and securely attached to the support member 310, such as by welding, bolting and/or the like. The support plate 330 generally will have a number of holes drilled onto it through which the fan hub assembly 200 can be attached using bolts and/or the like.

The sleeve assembly 320 includes an inner sleeve member 324 about which are placed a fixed upper outer sleeve member 322 and a free large rotatable lower outer sleeve member 326. The inner sleeve member 324 will be securely attached to the support member 310, such as by welding or the like. It should be appreciated that any known or later developed method for securely attaching the upper outer sleeve member 322 to the inner sleeve 324 can be used. Typically, the outer fixed sleeve member 322 will be securely attached to the inner sleeve member 324. In various exemplary embodiments, the fixed upper outer sleeve member 322 is welded to the inner sleeve member 324. In various exemplary other embodiments, the fixed upper outer sleeve member 322 is glued or otherwise adhered to the inner sleeve member 324. It should be appreciated that any known or later developed method for securely attaching the upper outer sleeve member 322 to the inner sleeve 324 can be used.

The lower outer sleeve member 326 typically contains two or more eye bolts or the like that allow guy wires to be attached to the lower outer sleeve member 326 and to support points on the building enclosing the large space in which the large area fan 100 is mounted. The sleeve assembly 320 and the guy wires act to stabilize the position of the bottom of the support structure 300 and the attached fan blade hub assembly 200. The lower outer sleeve 326 and the guy wires attached to it allow the support structure 300 to rotate around its axis without stretching or otherwise straining or stressing the guy wires. This will be described in greater detail below.

Figure 10:
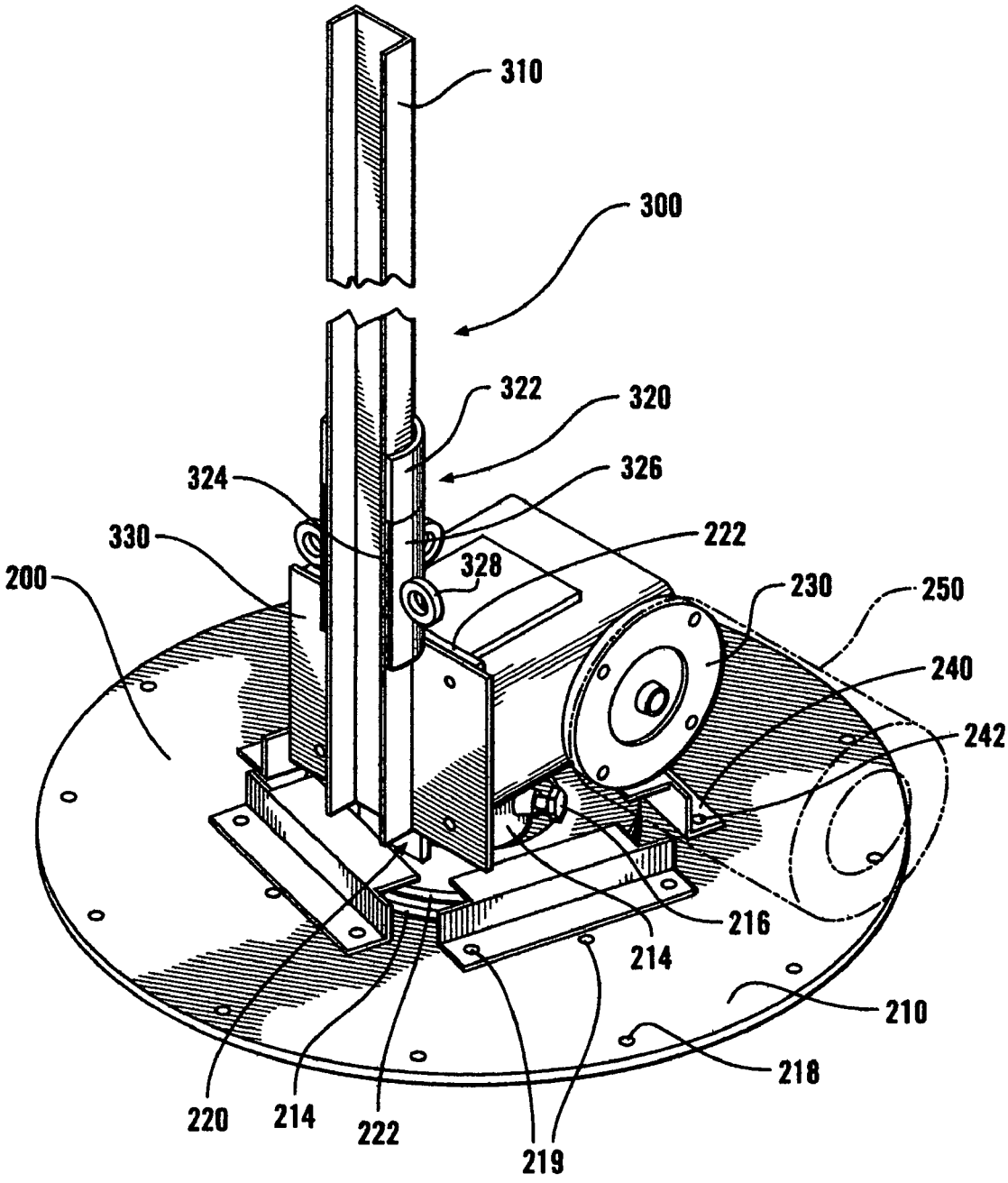
FIG. 10 is a top perspective view of one exemplary embodiment of a fan hub assembly and the support structure shown in FIG. 9; of a fan according to this invention.
Figure 11:
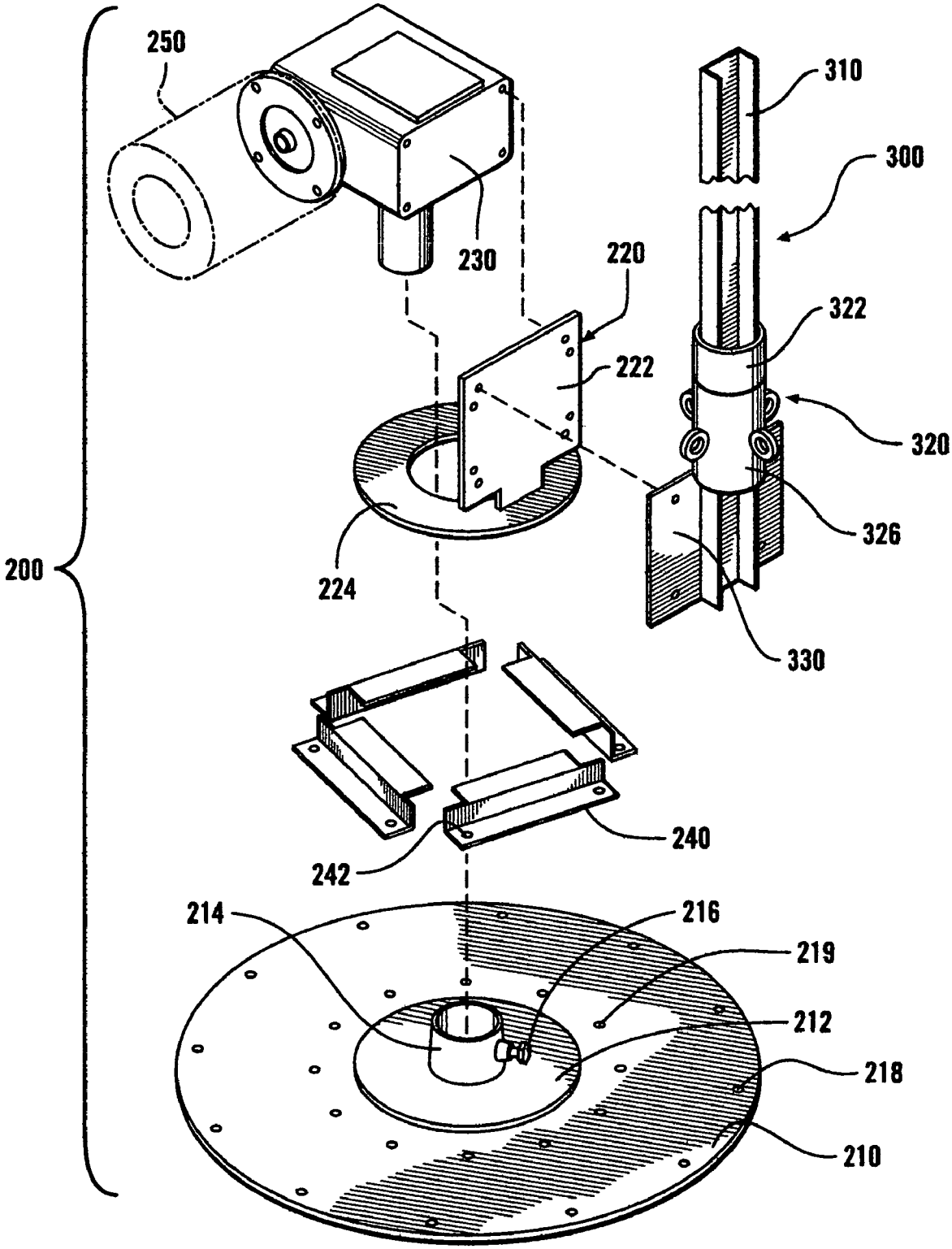
FIG. 11 is an exploded view of the mounting plate, safety plate and catches, gear box and support structure of FIG. 10.

FIG. 10 shows one exemplary embodiment of a fan hub assembly 200 according to this invention, as attached to the exemplary embodiment of the support structure 300 showing FIG. 9. As shown in FIG. 10, the fan hub assembly 200 includes the fan plate 210, a safety and mounting plate assembly 220, a gear box 230 and a plurality of safety catches 240. FIG. 11 shows these elements of the fan hub assembly 200 in an exploded view that allows the details of these elements to be seen in greater detail.

As shown in FIGS. 10 and 11, the fan blade hub plate 210 includes a center mounting plate 212 and a mounting collar 214. The mounting collar 214 includes a mounting screw set screw or the like 216 that extends through the thickness of mounting collar 214. In various exemplary embodiments, the mounting collar 214 is welded or otherwise securely attached to the mounting plate 212, which is in turn, welded or otherwise securely attached to the fan blade hub plate 210. In various exemplary embodiments, the mounting collar 214 can have a constant thickness or can have a trapezoidal cross section such that the thickness of the mounting collar 214 are thicker near the mounting plate 212 and are thinner away from the mounting plate 212. In various other exemplary embodiments, the mounting collar 214 and the mounting plate 212 can be machined from a single piece of metal or the like. It should be appreciated that, when the mounting collar 214 is welded or otherwise attached to the mounting plate 212, stabilizing bars extending at an angle from the outer surface of the mounting collar 214 to the mounting plate 212 can be used to provide additional stability between the mounting collar 214 and the mounting plate 212.

As further shown in FIGS. 10 and 11, a series of mounting holes 218 are located around the edge of the fan blade hub plate 210, while a second series of mounting holes 219 are located around the mounting plate 212. It should be appreciated that the bolts 222 and 224 respectively will pass through the bolt holes 219 and 218, respectively. As shown in FIGS. 10 and 11, in various exemplary embodiments, a pair of inner and outer bolt holes 218 and 219 for a particular fan blade 110 or 150 need not be arranged along a radius of the fan blade hub plate 210. Rather, as shown in FIGS. 10 and 11, a single set 217 of the bolt holes 218 and 219 are located such that a particular fan blade 110 or 150 does not lie along a radius of the fan blade hub plate 210. Rather, a given fan blade 110 or 150 is attached to the fan blade hub plate 210 using the bolt holes 218 and 219 such that the free end 114 or 154 of the fan blade 110 or 150 respectively, is slightly ahead of the hub end 112 or 152, respectively, along the circumferential direction of the large area fan 100.

As shown in FIGS. 10 and 11, the mounting and safety plate assembly 220 includes a mounting plate 222 and a safety plate 224. As most easily seen in FIG. 11, the mounting plate 222 includes a first set of bolt holes that align with bolt holes on the mounting plate 330 of the support assembly 300. A second set of bolt holes on the mounting plate 220 align with bosses provided on the gear box 230. As shown in FIG. 11, a fairly large hole is formed in the center portion of the safety plate 224. As shown in FIG. 10, when the fan blade hub assembly 200 is assembled, the mounting collar 214 extends through the hole in the safety plate 224.

As shown in FIGS. 10 and 11, the gear box 230 includes an output drive shaft or spindle 232 and an input mounting plate 234. When the fan blade hub assembly 200 is assembled, the output drive shaft or spindle 232 extends through the center opening in the safety plate 224 when the mounting plate 220 is bolted to the gear box 230. The drive shaft or spindle 232, along with the mounting and safety plate assembly 220, is connected to the fan blade hub plate 210 by extending the drive shaft or spindle 232 into the center portion of the mounting collar 214 and tightening the mounting screw 216. In various exemplary embodiments, the drive shaft or spindle 232 will have a matching hole into which the mounting screw 216 will extend. It should be appreciated that, in various exemplary embodiments, this hole on the spindle 232 can be either threaded or unthreaded.

As shown in FIGS. 10 and 11, a series of safety catch plates 240 are mounted to the fan blade hub plate 210 and extended up and over the top surface of the safety plate 224 of the mounting and safety plate assembly 220. As shown in FIG. 10, pairs of mounting holes 242 on the safety catch plates 240 align with two of the mounting holes 219 on the fan blade hub plate 210. In general, the bolts 222 are sufficiently long enough to extend through the fan blades 110 or 150, the fan blade mounting plate 210 and the bolt holes 242 of the safety catch plate 240 to allow the safety catch plates 240 to be securely attached to the fan blade hub plate 210. In normal operation, the safety catch plates 240 rotate with the fan blade hub plate 210, with their inter-projecting portions 244 extending over but not contacting the safety plate 224. However, should the drive shaft or spindle 232 fail, the mounting collar 214 and/or the mounting plate 212 become detached from the fan blade hub plate 210 and/or the spindle 232 slip out of the mounting collar 214, rather than the fan blade hub plate 210 and all of the attached fans 110 crashing to the ground, the projecting portions 244 of the safety catch plates 240 will catch or hang on the safety plate 224. Thus, the safety catches 240, in combination with the safety catch plate 224, prevent mounting failures between the gear box 230 and the fan blade hub plate 210 from resulting in catastrophic failure of the large area fan 100.

Accordingly, it should be appreciated that the safety catches 240 be sufficiently strong enough to support the weight of the fan blade hub plate 210 and the attached fan blades 110 or 150 and that the bolts 122 and 162 be sufficiently strong enough to support the weight of the fan blade hub plate 210, the hub assembly 200 and the fan blades 110 or 150, respectively. Likewise, the safety plate 224 needs to be sufficiently strong and rigid enough to support the weight of the fan blade hub plate 210 and the fan blades 110 or 150. Similarly, the connection between the mounting plate 222 and the safety plate 224 and the bolts connecting the mounting plate 222 to the mounting plate 330 need to be sufficiently strong enough to support the weight of the fan blade hub plate 210 and the attached fan blades 110 or 150.

Figure 12:
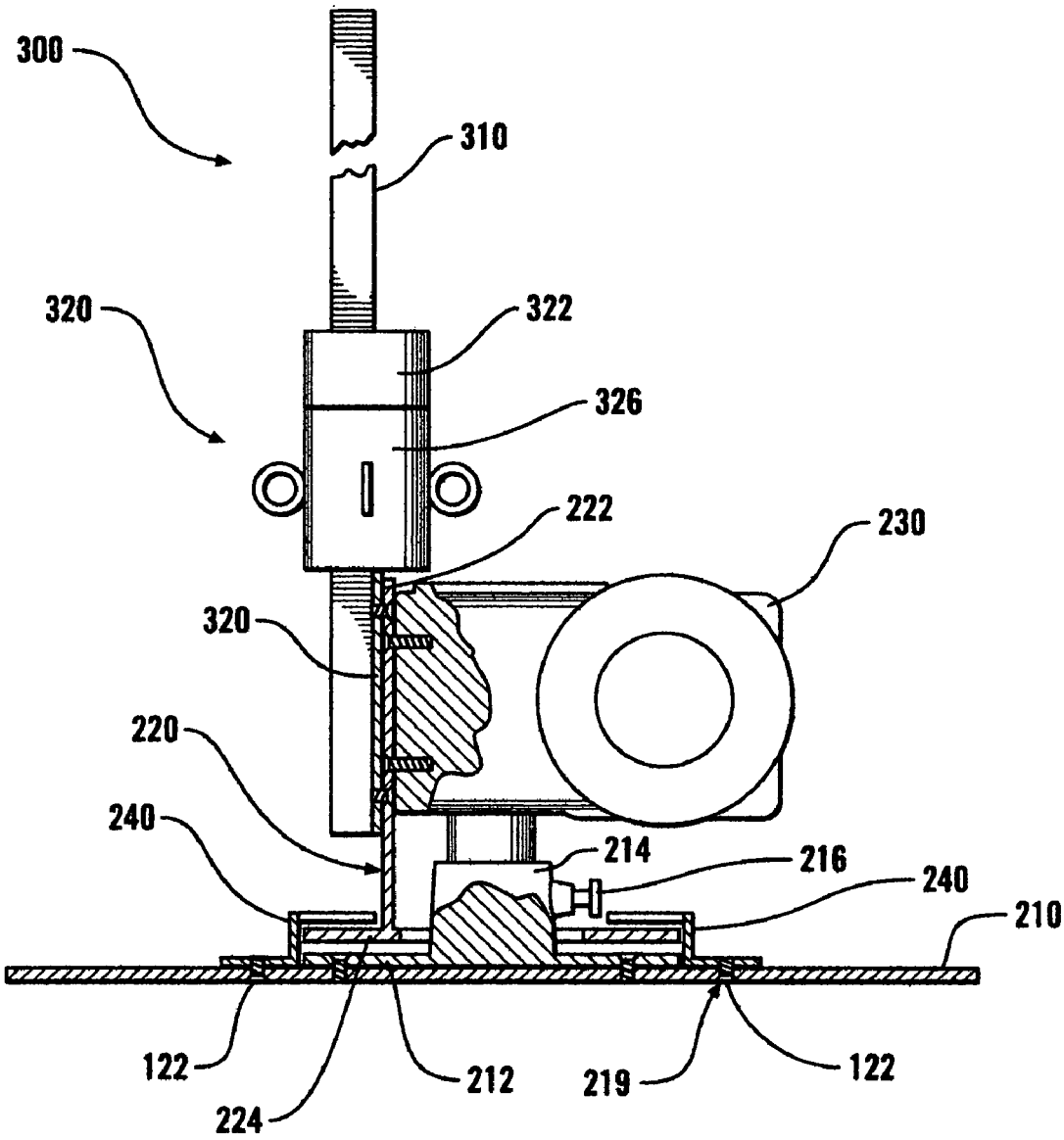
FIG. 12 is a side view of the fan hub assembly and the support structure according to this invention

FIG. 12 is a side view in part cross sectional view of the assembled support structure 300 and fan blade assembly 200 showing the spatial relationships between the fan blade hub plate 210, the safety catches 240, the safety plate 224 and mounting plate 222, the drive shaft or spindle 230 and the mounting collar 214, along with the bolts 122 or 152 and the various bolts connecting the mounting plate 222 to the gear box 230 and to the mounting plate 330.

Figure 13:
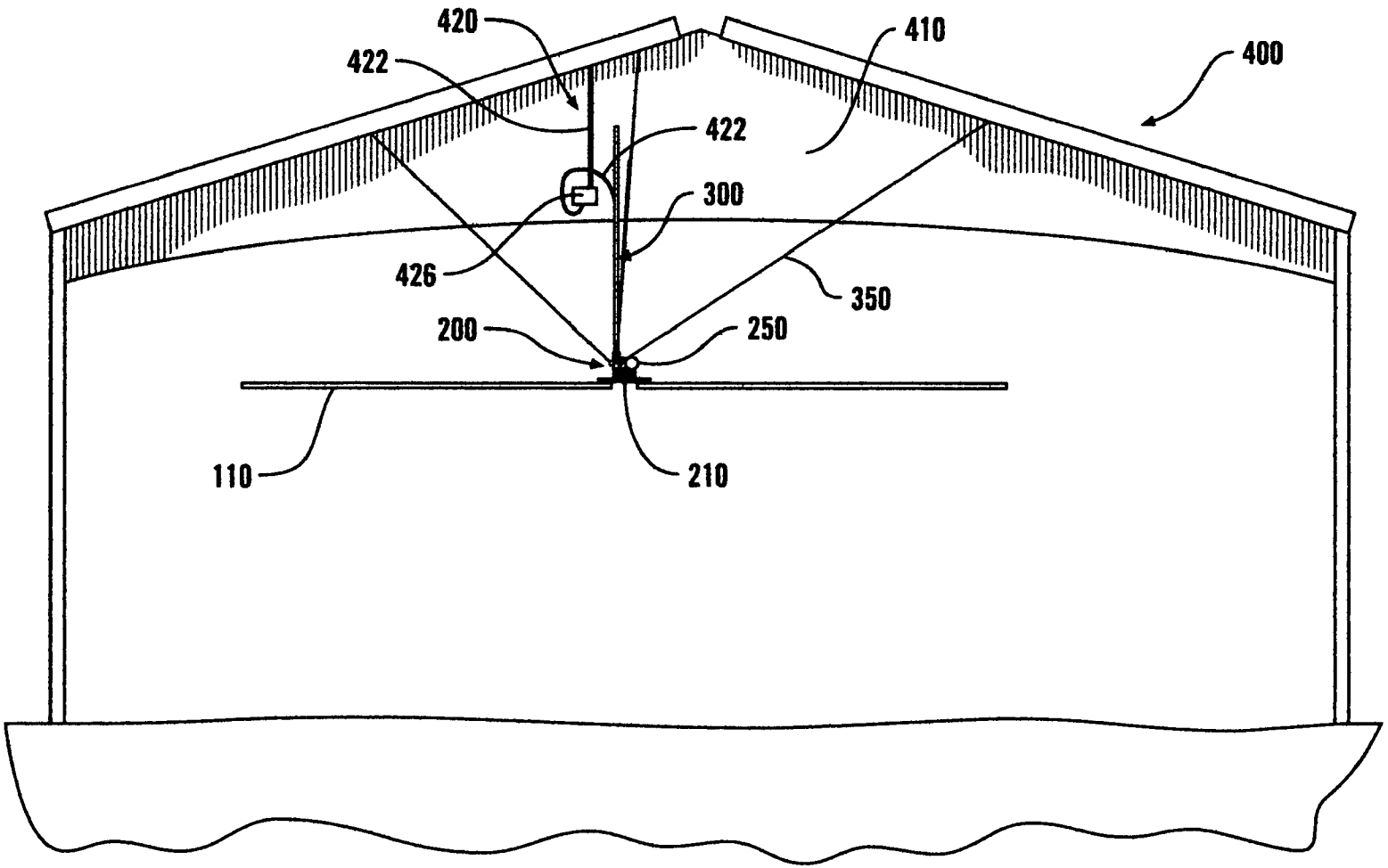
FIG. 13 is a side view of a first exemplary embodiment of a fan according to this invention when installed in a large space.

FIG. 13 shows a first exemplary embodiment for mounting one exemplary embodiment of a large area fan 100 and fan blades 110 according to this invention inside a building having a large area to be covered by the large area fan 100. As shown in FIG. 9, the building 400 has a ceiling rafter or joist 410 to which the support structure 300 is mounted. The building 400 also has electric service 420 apprising a first conduit 422 leading to a junction box 426 and a flexible wiring element 424 extending from the junction box 426 and extending down the support member 300 to a motor 250 of the fan blade hub assembly 200. As shown in FIG. 13, a number of guy wires are attached to the lower outer sleeve 326 of the sleeve assembly 300. In the exemplary embodiment shown in FIG. 13, the large area fan is mounted such that the fan blades 110 are more or less parallel to the floor of the building 400.

Figure 14:
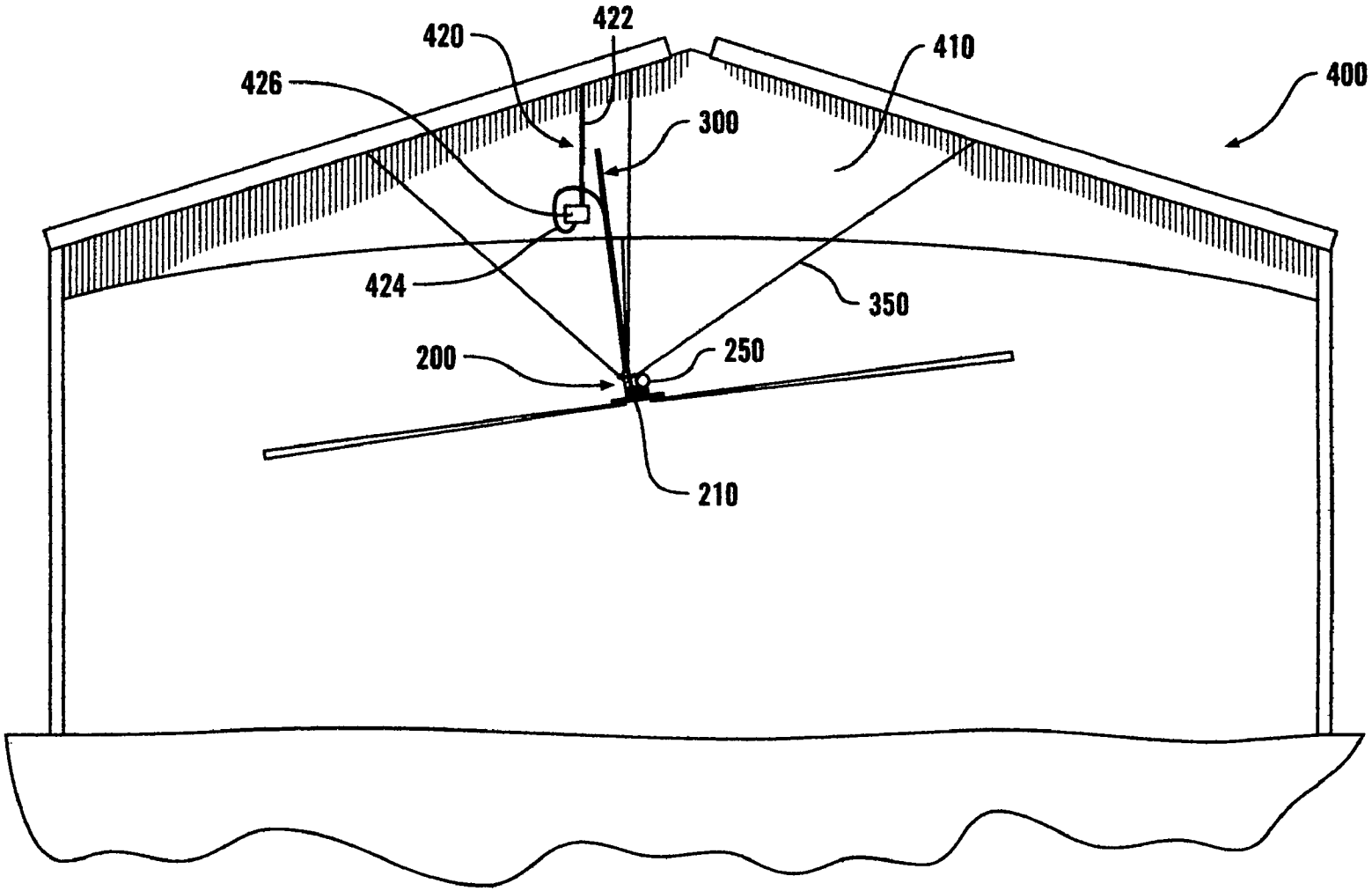
FIG. 14 is a side view of a second exemplary embodiment of a fan according to this invention when installed in a large space.

FIG. 14 shows a second exemplary embodiment for mounting one exemplary embodiment of a large area fan 100 and fan blades 150 according to this invention inside a building having a large area to be covered by the large area fan 100. As shown in FIG. 14, it should be appreciated that the support structure 310 can be attached to the rafter 410 or the like in a way that tilts the fan blades 150 (or 110) relative to the floor of the building 400. In various exemplary embodiments, the tilt is typically on the order of about 5° to about 10°. By tilting the larger fan 100, the large area fan 100 can be located further to one side of the building 400, that is, away from the center line of the building 400. When the large area fan 100 is tilted, and placed off to one side of the building 400, in operation, the large area fan 100 is still able to generate sufficient air movement to cover the entire width of the building 400.

Figure 15:
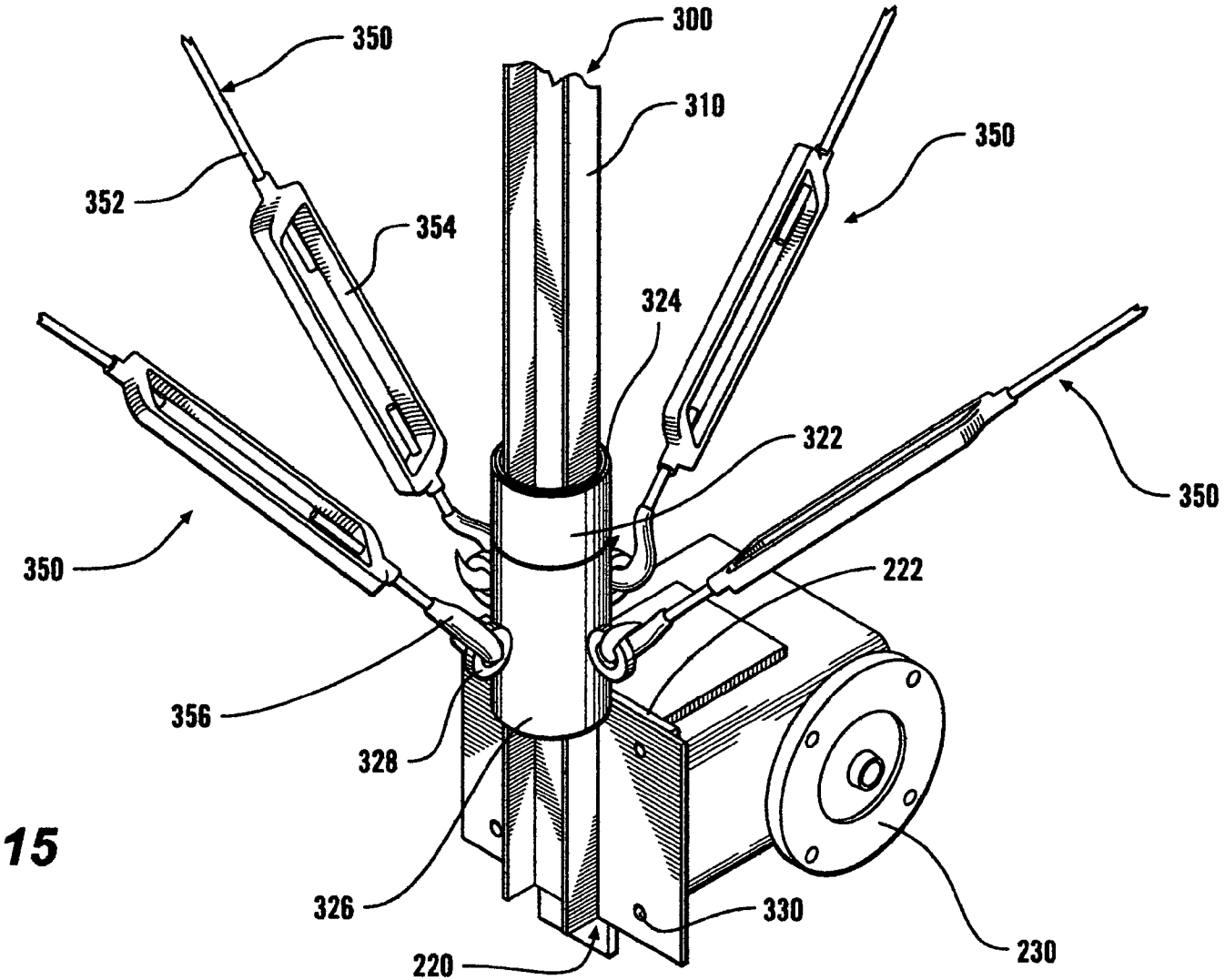
FIG. 15 is a top perspective view of one exemplary embodiment of the support structure and the fan hub assembly according to this invention as installed.

FIG. 15 illustrates one exemplary embodiment of the guy wires 350 and the sleeve assembly 320 of the support structure 300. As shown in FIG. 15, a number of attachment points or eyelets 328 are mounted on the outer surface of the lower outer sleeve member 326. A plurality of guy wires, each comprising a wire 352, a turnbuckle 354 and a hook 356 are attached to the attachment points or eyebolts 328.

As suggested above, as the fan blades 110 or 150 of the large area fan 100 rotate, a significant torque or rotational force is transmitted from the fan blades 110 or 150 through the fan hub assembly 200 to the support structure 300. When the fan blades 110 or 150 are rotating in a forward direction, this force is a backwards torque due to the mass of the air being moved by the fan blades 110 or 150 and the distribution of that mass along the fan blades 110 or 150, as well as the drag generated as the fan blades 110 or 150 move through the air in the large space in which the large area fan 100 in placed. In general, this force will generally gradually build up when the large area fan 100 is first turned on and will generally gradually dissipate once the large area fan 100 is turned off.

However, in various situations, the large area fan 100 may experience an immediate or abrupt loss of power. This can occur due to a loss of power due to a storm or other power outage, a circuit breaker tripping due to a short circuit condition, a power surge or the like, a gearbox failure, a motor failure, or the like. In any case, the large area fan 100 may experience a situation where the fan blades 110 or 150 come to a stop in a very short amount of time. While the fan blades 110 or 150 may immediately stop moving relative to the fan blade assembly 200, due to the large amount of rotational energy stored in the fan blades 110 or 150, the fan blades 110 or 150 will typically continue to rotate relative to ground, slightly causing the support member 310 to twist on its axis.

The sleeve assembly 320 allows the support member 310 to twist without putting any additional stress or strain on eyebolts 328, the guy wires 352, the turnbuckles 354 and/or the hooks 356. Without the sleeve assembly 320, it is possible that this twisting of the support member 310 could stretch one or more of the guy wires 352 and/or break one or more of the eyebolts 328, the guy wires 352, the turnbuckles 354 and/or the hooks 356.

In various exemplary embodiments, the gear box 230 is a 90 degree angle worm gear box, which may or may not include an integral motor. It should be appreciated that, while the fan blades 110 or 150 may put less strain on the gearbox 230 and/or motor 250 than a conventional large area fan, the gearbox 230 and the motor 250 nonetheless must be of sufficiently high duty. The applicant has determined that light duty gear motors, such as the Emerson 45-rpm 3N176 gear motor will experience 50% or more failures within one year of operation. The applicant has determined that heavier duty gear boxes and separate motors, such as a 1 hp Leeson motor and a Boston 44-rpm IL364 gearbox will withstand over one year of normal use without failure.

While this invention has been described in conjunction with the exemplary embodiments outlined above, various alternatives, modifications, variations, improvements, and/or substantial equivalents, whether known or that are or may be presently unforeseen, may become apparent to those having at least ordinary skill in the art. Accordingly, the exemplary embodiments of the invention, as set forth above, are intended to be illustrative, not limiting. Various changes may be made without departing from the spirit and scope of the invention. Therefore, the invention is intended to embrace all known or later-developed alternatives, modifications variations, improvements, and/or substantial equivalents. It should also be appreciated that, in the above description, dimensions have been given in English units with approximate metric equivalents. Where present, the metric units are approximations and are not intended to be further limiting than the previously stated English units.

What is claimed is:

1. A large area fan, comprising:

a drive assembly connected to a power source and having an output shaft;

a fan blade hub connected to the output shaft of the drive assembly; and a plurality of fan blades each at least 4 feet in length, approximately up to 6 inches in width and approximately up to 0.16 inches in thickness connected to the fan blade hub, wherein each fan blade has at least a portion in a concave shape that when rotated, redirects a gas, within a large area in which the large area fan is located, both in a vector flow radially along the fan blade and in a vector flow downward from the fan blade.

2. The large area fan of claim 1, wherein at least one fan blade comprises a convex outer surface and a concave inner surface.

3. The large area fan of claim 2, wherein at least the concave inner surface has a radius of curvature of at least about 4 inches.

4. The large area fan of claim 2, wherein at least the concave inner surface has a radius of curvature of at most about 4.5 inches.

5. The large area fan of claim 2, wherein at least one of the concave inner surface and the convex outer surface has an arc length of at least about 55 degrees.

6. The large area fan of claim 1, wherein each fan blade has at least a portion that extends away from a plane of the fan blade hub at least about an angle of 45 degrees from the plane of the fan blade hub.

7. The large area fan of claim 1, wherein each fan blade has at least a portion that extends at least 3.5 inches away from the plane of the fan blade hub.

8. The large area fan of claim 1, wherein each fan blade has at least a portion that extends at least 5.5 inches away from the plane of the fan blade hub.

9. The large area fan of claim 1, wherein each fan blade has at least a portion that extends away from a plane of the fan blade hub at least about an angle of 60 degrees from the plane of the fan blade hub.

10. The large area fan of claim 1, wherein each fan blade has at least a portion that extends away from a plane of the fan blade hub at least about an angle of 75 degrees from the plane of the fan blade hub.

11. A large area fan, comprising:

a drive assembly connectable to a power source and having an output shaft;

a fan blade hub connected to the output shaft of the drive assembly; and a plurality of fan blades each at least 4 feet in length, approximately up to 6 inches in width and approximately up to 0.16 inches in thickness connected to the fan blade hub, wherein each fan blade has at least a portion in a concave shape that when rotated creates a generally conical flow of a gas within a large area in which the large area fan is located, away from a plane of rotation of the plurality of fan blades, wherein:

each fan blade has a first end near the fan blade hub and a second end spaced from the fan blade hub such that each fan blade, as it extends from the fan blade hub, remains substantially in the plane of rotation.

12. The large area fan of claim 11, wherein the drive assembly comprises:

an electric motor having an output shaft; and a gearbox connected to the output shaft of the electric motor and having an output shaft; wherein the output shaft of the drive assembly is the output shaft of the gearbox.

13. The large area fan of claim 11, wherein each fan blade extends at least 4 feet from the fan blade hub.

14. The large area fan of claim 11, wherein each fan blade is a single piece.

15. The large area fan of claim 11, wherein at least one fan blade comprises:

a first relatively flat portion having a leading edge and a rear edge; and a second relatively curved portion extending from the rear edge of the first relatively flat portion, wherein:

the first relatively flat portion is connected to one surface of the fan blade hub such that the second relatively curved portion extends away from the fan blade hub; and the first relatively flat portion is substantially parallel to a plane of the fan blade hub.

16. The large area fan of claim 15, wherein each fan blade comprises the first relatively flat portion and the second relatively curved portion.

17. The large area fan of claim 15, wherein the large area fan further comprises, for at least one fan blade, a support member adjacent to the first relatively flat portion and extending along that fan blade from the fan blade hub.

18. The large area fan of claim 17, wherein the large area fan comprises at least one support member for each fan blade.

19. The large area fan of claim 17, wherein the support member extends about one-third of a length of that fan blade along that fan blade from the fan blade hub.

20. The large area fan of claim 17, wherein the second relatively curved portion comprises a curved outer surface and a curved inner surface, each of the curved inner and outer surfaces having a radius of curvature of between about 4 inches and about 4.5 inches.

21. The large area fan of claim 15, wherein the second relatively curved portion comprises a convex outer surface and a concave inner surface, at least the concave inner surface having a radius of curvature of at least about 4 inches.

22. The large area fan of claim 15, wherein the second relatively curved portion comprises a convex outer surface and a concave inner surface, at least the concave inner surface having a radius of curvature of at most about 4.5 inches.

23. The large area fan of claim 15, wherein the second relatively curved portion comprises a curved outer surface and a curved inner surface.

24. The large area fan of claim 23, wherein at least the curved inner surface is concave and has a radius of curvature of at least about 4 inches.

25. The large area fan of claim 23, wherein at least the curved inner surface is concave and has a radius of curvature of at most about 4.5 inches.

26. The large area fan of claim 23, wherein at least one of the curved inner and outer surfaces has an arc length of at least about 55 degrees.

27. The large area fan of claim 15, wherein each fan blade has at least a portion that extends away from a plane of the fan blade hub at least about an angle of 45 degrees from the plane of the fan blade hub.

28. The large area fan of claim 27, wherein each fan blade has at least a portion that extends away from a plane of the fan blade hub at least about an angle of 60 degrees from the plane of the fan blade hub.

29. The large area fan of claim 27, wherein each fan blade has at least a portion that extends away from a plane of the fan blade hub at least about an angle of 75 degrees from the plane of the fan blade hub.

30. The large area fan of claim 11, wherein:

at least one fan blade comprises a curved outer surface and a curved inner surface and has a leading edge and a trailing edge and an inner end and an outer end, the leading edge of a portion of the fan blade at the inner end is attached to the fan blade hub; and the outer end is offset circumferentially away from the fan hub plate relative to the inner end such that the outer end is at a greater angle of attack than the inner end.

31. The large area fan of claim 30, wherein each of the curved inner and outer surfaces have a radius of curvature of about 4 inches to about 4.5 inches.

32. The large area fan of claim 30, wherein each of the curved inner and outer surfaces have arc lengths of about 55 degrees to about 65 degrees.

33. The large area fan of claim 30, wherein the outer end is offset circumferentially away from the fan hub plate relative to the inner end by about ⅛ inch per foot of length of the fan blade.

34. The large area fan of claim 30, wherein the outer end is offset circumferentially away from the fan hub plate relative to the inner end by twisting the fan blade.

35. The large area fan of claim 1, further comprising:

a mounting pole that extends from a portion of a structure enclosing a large area in which the large area fan is located, the portion of the structure able to support a weight of the large area fan; and a mounting plate connected to one end of the mounting pole, the drive assembly detachably connected to the mounting plate.

36. The large area fan of claim 11, wherein at least one fan blade comprises a convex outer surface and a concave inner surface.

37. The large area fan of claim 36, wherein at least the concave inner surface has a radius of curvature of at least about 4 inches.

38. The large area fan of claim 37, wherein at least the concave inner surface has a radius of curvature of at most about 4.5 inches.

39. The large area fan of claim 37, wherein at least one of the concave inner surface and the convex outer surface has an arc length of at least about 55 degrees.

40. The large area fan of claim 37, wherein each fan blade has at least a portion that extends away from a plane of the fan blade hub at least about an angle of 45 degrees from the plane of the fan blade hub.

41. The large area fan of claim 40, wherein each fan blade has at least a portion that extends away from a plane of the fan blade hub at least about an angle of 60 degrees from the plane of the fan blade hub.

42. The large area fan of claim 40, wherein each fan blade has at least a portion that extends away from a plane of the fan blade hub at least about an angle of 75 degrees from the plane of the fan blade hub.

43. A large area fan comprising:

a drive assembly connectable to a power source and having an output shaft;

a fan blade hub connected to the output shaft of the drive assembly;

a plurality of fan blades connected to the fan blade hub;

a mounting pole that extends from a portion of a structure enclosing a large area in which the large area fan is located, the portion of the structure able to support a weight of the large area fan; a mounting plate connected to one end of the mounting pole, the drive assembly detachably connected to the mounting plate;

a plurality of safety catches attached to the fan blade hub, each safety catch comprising: a first portion extending away from the plane of the fan blade hub and having a first end spaced from the fan blade hub;

and a second portion connected to the first end of the first portion, the second portion extending generally parallel to the fan blade hub and toward an axis of the fan blade hub; and a catch plate located axially between the plurality of safety catches and the fan blade hub and radially inwardly of the plurality of safety catches, the catch plate having a central hole through which the output shaft of the drive assembly extends, the catch plate attached to the mounting plate.

44. A large area fan comprising: a drive assembly connectable to a power source and having an output shaft;

a fan blade hub connected to the output shaft of the drive assembly;

a plurality of fan blades connected to the fan blade hub;

a mounting pole that extends from a portion of a structure enclosing a large area in which the large area fan is located, the portion of the structure able to support a weight of the large area fan;

a mounting plate connected to one end of the mounting pole, the drive assembly detachably connected to the mounting plate;

a first sleeve fixed to a portion of the mounting pole above the mounting plate; a second sleeve surrounding the first sleeve, the first and second sleeves able to rotate relative to each other;

a third sleeve surrounding and attached to the first sleeve, the second sleeve located below the third sleeve; and a plurality of attachment structures attached to the second sleeve, wherein a plurality of support devices can be attached to the plurality of attachment structures.

* * * * *

UNITED STATES PATENT AND TRADEMARK OFFICE

CERTIFICATE OF CORRECTION

PATENT NO. : 7,625,186 B1
APPLICATION NO. : 11/120782
DATED : December 1, 2009
INVENTOR(S) : Lueddecke It is certified that error appears in the above-identified patent and that said Letters Patent is hereby corrected as shown below:

In the Specification

In Column 5, Line 7, delete "ajig" and insert -- a jig --, therefor.

In Column 5, Line 41, delete "are 110" and insert -- 110 are --, therefor.

In Column 9, Line 15, delete "discarded s" and insert -- discarded as --, therefor.

In Column 10, Line 41, delete "blades 50" and insert -- blades 150 --, therefor.

In Column 11, Line 37, delete "(2·4.148·/6)" and insert -- (2·4.148·π/6) --, therefor.

In Column 16, Line 43, delete "fans 110" and insert -- fan blades 110 --, therefor.

In Column 17, Line 14, delete "member 300" and insert -- member 310 --, therefor.

In Column 17, Line 17, delete "assembly 300." and insert -- assembly 320. --, therefor.

In Column 17, Line 25, delete "structure 310" and insert -- structure 300 --, therefor.

In the Claims

In Column 19, Line 3, in Claim 6, delete "hub at" and insert -- hub at at --, therefor.

In Column 19, Line 13, in Claim 9, delete "hub at" and insert -- hub at at --, therefor.

In Column 19, Line 17, in Claim 10, delete "hub at" and insert -- hub at at --, therefor.

In Column 20, Line 31, in Claim 27, delete "hub at" and insert -- hub at at --, therefor.

In Column 20, Line 35, in Claim 28, delete "hub at" and insert -- hub at at --, therefor.

In Column 20, Line 39, in Claim 29, delete "hub at" and insert -- hub at at --, therefor.

In Column 20, Line 63, in Claim 35, delete "claim 1," and insert -- claim 11, --, therefor.

In Column 21, Line 18, in Claim 40, delete "hub at" and insert -- hub at at --, therefor.

In Column 21, Line 22, in Claim 41, delete "hub at" and insert -- hub at at --, therefor.

In Column 21, Line 26, in Claim 42, delete "hub at" and insert -- hub at at --, therefor.

Signed and Sealed this
Twenty-sixth Day of November, 2013

Margaret A. Focarino

Margaret A. Focarino
*Commissioner for Patents of the United States Patent and Trademark Office*